US009066559B2

(12) United States Patent
Butler

(10) Patent No.: US 9,066,559 B2
(45) Date of Patent: Jun. 30, 2015

(54) BI-LAYER ORTHOTIC AND TRI-LAYER ENERGY RETURN SYSTEM

(71) Applicant: Barry A. Butler, Owatonna, MN (US)

(72) Inventor: Barry A. Butler, Owatonna, MN (US)

( * ) Notice: Subject to any disclaimer, the term of this patent is extended or adjusted under 35 U.S.C. 154(b) by 165 days.

(21) Appl. No.: 13/827,949

(22) Filed: Mar. 14, 2013

(65) Prior Publication Data

US 2014/0000125 A1 Jan. 2, 2014

Related U.S. Application Data

(60) Provisional application No. 61/707,344, filed on Sep. 28, 2012, provisional application No. 61/665,097, filed on Jun. 27, 2012.

(51) Int. Cl.

*A43B 13/18* (2006.01)
*A43B 13/38* (2006.01)
*A43B 7/14* (2006.01)

(52) U.S. Cl.

CPC ..... *A43B 13/386* (2013.01); *A43B 7/141* (2013.01); *A43B 7/142* (2013.01); *A43B 7/149* (2013.01); *A43B 13/183* (2013.01); *A43B 13/184* (2013.01)

(58) Field of Classification Search

CPC ..... A43B 13/18; A43B 13/181; A43B 7/14; A43B 13/386
USPC ..... 36/43, 27, 28, 7.8
See application file for complete search history.

(56) References Cited

U.S. PATENT DOCUMENTS 5,138,776 A * 8/1992 Levin ..... 36/38
5,701,685 A * 12/1997 Pezza ..... 36/7.8
5,706,589 A * 1/1998 Marc ..... 36/27
5,766,265 A 6/1998 Phillips
6,247,249 B1 * 6/2001 Lindqvist ..... 36/28
6,942,704 B2 9/2005 Sulprizio
2003/0188455 A1 * 10/2003 Weaver, III ..... 36/27
2005/0005472 A1 * 1/2005 Perenich ..... 36/27
2005/0081401 A1 * 4/2005 Singleton et al. ..... 36/34 R
2005/0126039 A1 6/2005 Levert et al.
2005/0262725 A1 * 12/2005 Rennex et al. ..... 36/7.8
2006/0048411 A1 * 3/2006 Lindqvist et al. ..... 36/27
2006/0236564 A1 10/2006 Allard et al.
2007/0038042 A1 2/2007 Freeman et al.
2008/0196273 A1 8/2008 Kosta
2009/0013556 A1 1/2009 Nishiwaki et al.
2009/0064536 A1 * 3/2009 Klassen et al. ..... 36/27
2010/0175279 A1 7/2010 Segel
2011/0009982 A1 1/2011 King et al.
2011/0167674 A1 7/2011 Langer
2011/0320012 A1 12/2011 Christensen et al.
2013/0125422 A1 * 5/2013 Perenich ..... 36/102
2015/0026996 A1 * 1/2015 Baum et al. ..... 36/27

OTHER PUBLICATIONS

International Search Report and Written Opinion issued by the U.S. Receiving Office, from corresponding International patent application Serial No. PCT/US13/62095, mailed Feb. 24, 2014; 10 pages.

* cited by examiner

*Primary Examiner* — Marie Bays

(74) *Attorney, Agent, or Firm* — Barbara A. Wrigley; Oppenheimer Wolff & Donnelly LLP

(57) ABSTRACT

A tri-layer energy return system is provided. The tri-layer energy return system includes a base; an orthotic; a platen directly or indirectly operably coupled to the base, the orthotic or both. A lever including a slide portion is movably received by said base. A tensioning member is coupled to said orthotic at an attachment point thereof.

29 Claims, 35 Drawing Sheets

BI-LAYER ORTHOTIC AND TRI-LAYER ENERGY RETURN SYSTEM

RELATED APPLICATION DATA

This application is a non-provisional of U.S. application Ser. No. 61/707,344, filed on Sep. 28, 2012, and claims priority to U.S. application Ser. No. 61/665,097, filed Jun. 27, 2012, the entireties of which are incorporated herein by reference.

FIELD OF THE INVENTION

The present invention relates generally to orthotics and more particularly to a bi-layer orthotic and a tri-layer orthotic configured to absorb energy and then return it to an individual wearer's foot.

BACKGROUND OF THE RELATED ART

Walking and running can be defined as methods of locomotion involving the use of the two legs, alternately, to provide both support and propulsion, with at least one foot being in contact with the ground at all times. While the terms gait and walking are often used interchangeably, the word gait refers to the manner or style of walking, rather than the actual walking process. The gait cycle is the time interval between the exact same repetitive events of walking.

The defined cycle can start at any moment, but it typically begins when one foot contacts the ground and ends when that foot contacts the ground again. If it starts with the right foot contacting the ground, then the cycle ends when the right foot makes contact again. Thus, each cycle begins at initial contact with a stance phase and proceeds through a swing phase until the cycle ends with the limb's next initial contact. Stance phase accounts for approximately 60 percent, and swing phase for approximately 40 percent, of a single gait cycle.

Hard surfaces in modern human environments have changed the forces encountered by the human musculoskeletal system during the gait cycle as compared to the forces which it evolved to sustain. Impact energies from such surfaces enter the body through boney and dense tissues and through soft and fatty tissues. Such impact energy frequently causes physical damage leading to injury, in particular injury of the foot. At times, this type of physical injury can be treated by an orthotic insert.

Functional orthotic inserts may be placed in a shoe either on top of or in place of the insole to correct foot alignment and side-to-side movement during standing, walking, running to influence the orientation of the bones in a human foot and to influence the direction and force of motion of the foot or parts of the foot. Orthotics thereby decrease pain, not only in the foot, but also in other parts of the body such as the knee, hip and lower back. They can also increase stability in an unstable joint and prevent a deformed foot from developing additional problems. However, conventional devices are not dynamic as designed. Conventional orthotic devices typically include a shimmed, rigid post and as a result dynamic adjustments to the foot during the gait cycle cannot be done. For example, adjustments such as making the foot tip out further, making the foot tip in further, raising the heel, raising the ball of the foot, and the like cannot be accomplished with conventional devices dynamically during the gait cycle.

Other causes of injury to the foot relate to underlying pathological disease states, such as by way of example, diabetes. Diabetes is a chronic disease that affects up to six percent of the population in the U.S. and is associated with progressive disease of the microvasculature. Complications from diabetes include not only heart disease, stroke, high blood pressure, diabetic retinopathy but also in particular diabetic neuropathic foot disease.

Diabetic neuropathic foot disease typically results in the formation of ulcers which commonly result from a break in the barrier between the dermis of the skin and the subcutaneous fat that cushions the foot during ambulation. This rupture may lead to increase pressure on the dermis. While there are devices and methods that purport to prevent planar ulcer formation in a diabetic patient there are no orthotic devices on the market that treat the ulcer with dynamic offloading after formation.

Other types of injury to the foot include fractures, pressure sores, surgical sites and overuse injuries. Patho-mechanical foot dysfunctions include supination and pronation pathologies.

Therefore, what is needed is a orthotic system that can be used remedially to correct deformities resulting from physical and other injuries to the foot. What is also needed is a dynamic orthotic system that can be used therapeutically to address underlying pathologies and patho-mechanical foot dysfunctions to accurately and precisely position the foot throughout the gait cycle in order to promote proper function and alignment and mitigate excessive forces.

BRIEF SUMMARY OF THE INVENTION

The aforementioned problems are addressed by the orthotic system in accordance with the present invention. In one aspect of the present invention, the system broadly includes a base layer; a platen; an orthotic and a lever operably coupling the base layer through a pass in the platen. The foregoing elements work together as a system to absorb energy in walking, running and the like and return it to the foot at the proper time and location. The orthotic may comprise a segmented orthotic or a non-segmented orthotic. The lever may include a slide portion and a draw pin or tensioning member that is anchored to the orthotic through the pass in the platen. The orthotic energy system in accordance with the invention controls the energy produced from the gait cycle to deform the orthotic layer in a particular location or in a particular angulation to supinate or pronate the foot. The system may also be adapted to address a variety of orthopedic remedial and therapeutic issues.

Also disclosed is a bi-layer orthotic that therapeutically addresses pronation and supination issues in a patent.

Also disclosed is an air-heel that is a bi-layer orthotic adapted to be cosmetically incorporated in women's shoes that promote proper function and alignment and mitigate excessive forces.

Also disclosed is an orthotic that includes a kick stand that moves medially or laterally to correct supination or pronation.

Those of skill in the art will appreciate that the orthotic systems disclosed herein have broad applications and may be incorporated into diabetic shoes; sports or athletic shoes; every day footwear including women's shoes, boots and the like whether a remedial or therapeutic result is desired without departing form the scope or spirit of the invention.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

Figure 1:
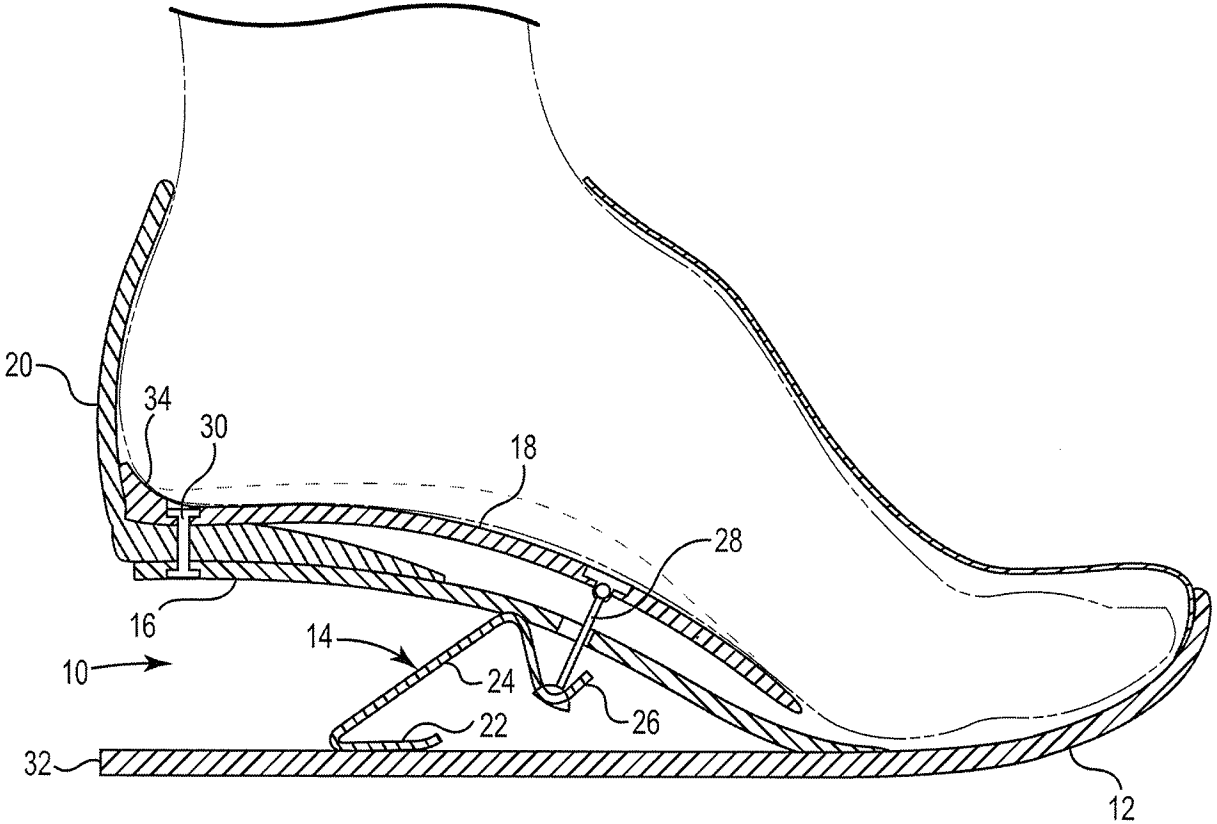
FIG. 1 is a side elevational view of the orthotic energy return system in accordance with the invention with foot shown in phantom dashed lines.

Referring now to FIGS. 1 through 6, a first embodiment of the orthotic energy return system in accordance with the invention is depicted. FIG. 1 illustrates a foot (in phantom lines) at rest wearing the energy return system 10 in accordance with the invention. The energy return system 10 is shown in the unburdened or off-loaded position with the base layer 12 at rest on a surface such as the ground. The energy return system 10 broadly includes base layer 12, lever 14, platen 16 and orthotic 18. Base 12 may be of any length so long as it generally extends from the sole of the foot to the toe region. Base 12 may comprise any material used for the soles of shoes including but not limited to rubber, plastics, polymers, polyurethanes and the like. Lever 14 includes slide 22, angled central portion 24 and angled connecting portion 26. Lever 14 is made from a material that is resilient to allow it to dynamically deform during the gait cycle. Suitable materials that may be utilized for lever 14 include plastics, polymers and resilient metals. Orthotic 18 is also made from a material that is resilient to allow it to dynamically deform during the gait cycle. Suitable materials that may be utilized to construct orthotic 18 include polyolefin; polypropylene, open and closed cell foams and graphites. Platen 16 is desirably made from rigid or semi-rigid materials such as plastics known to those of skill in the art.

Tensioning member 28 operably couples lever 14 at angled connecting portion 26 to orthotic 18. Tensioning member 28 is depicted as a pin however those of skill in the art will appreciate that rods, cables, wires, filaments and the like may be substituted for pin 28. Platen 16 may be substantially rigid and is operably coupled to orthotic 18, through heel cup 20, by connecting member 30. Connecting member 30 may comprise pins, rods, wires, filaments and the like. Those of skill in the art will appreciate that connecting member 30 may be eliminated and platen 16 may be indirectly coupled to orthotic 18 by adhesive means or chemical bonding between platen 16 and heel cup 20 and between heel cup 20 and orthotic 18.

The energy return system in accordance with the invention will now be described in operation. Referring now to FIGS. 2-5 the gait cycle and the operation of the energy return system is illustrated. Thus, an understanding of the gait cycle is helpful to the understanding of the operation of the energy return system in accordance with the invention.

The gait cycle begins when one foot contacts the ground and ends when that foot contacts the ground again. Thus, each cycle begins at initial contact with a stance phase and proceeds through a swing phase until the cycle ends with the limb's next initial contact. There are two phases of the gait cycle. Stance phase is the part of the cycle when the primary foot is in contact with the ground and begins with initial contact or heel strike and ends with toe-off. Swing phase occurs when the opposite, second foot is in the air and begins with toe-off and ends with the second heel strike.

Figure 2:
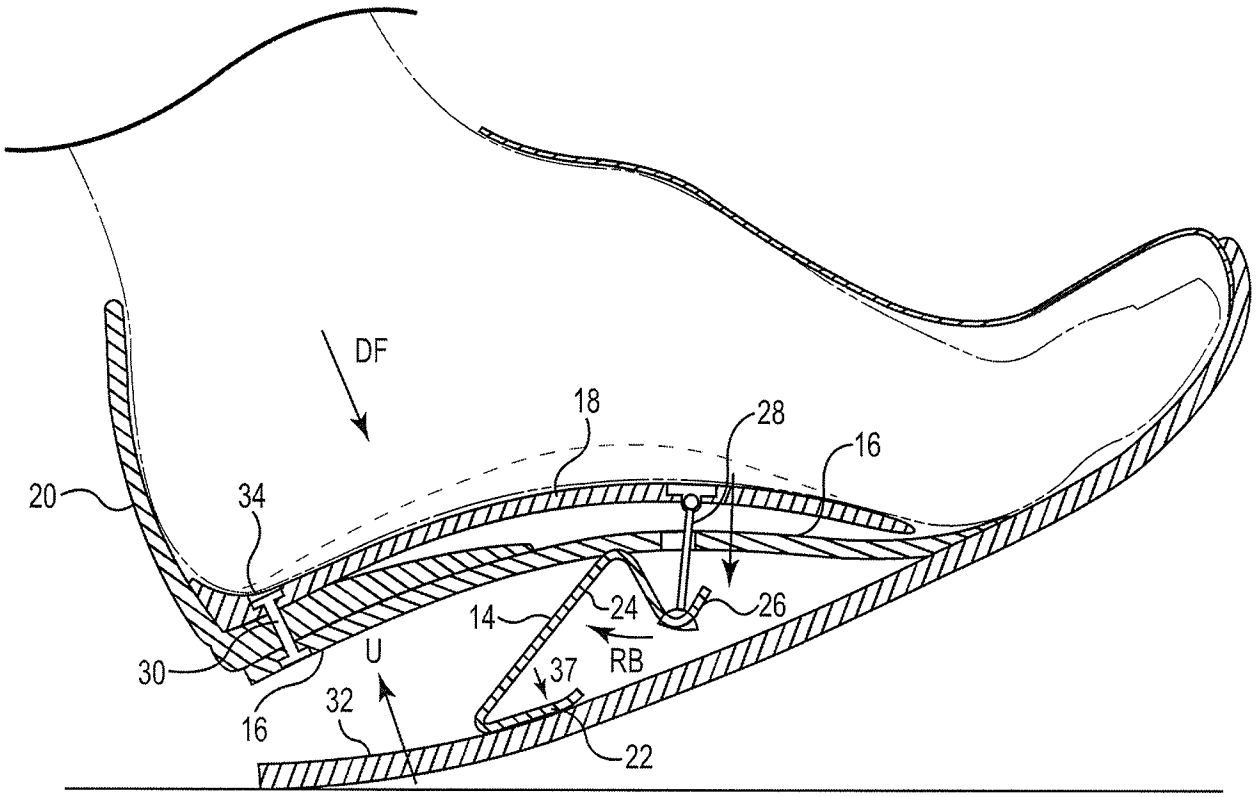
FIG. 2 is a view thereof wherein the subject has initiated the gait cycle.

Referring now to FIG. 2, the loading response begins with initial contact, the instant the primary foot contacts the ground. In a normal gait pattern, the heel of the primary foot contacts the ground first (unless the patient has equines as depicted in alternative embodiment in FIGS. 5-6). The downward force (DF) of the heel causes base layer 12 to deform upwardly toward the heel as noted by arrow U. Angled central portion 24 of lever 14 commences to compress downwardly 37 toward slide 22 as angled connecting portion rotates distally RB toward angled central portion 14 causing the buildup of tension on tensioning member 28. Because angled connecting portion 26 is operably coupled to orthotic 18 by tensioning member 28 the tensioning of tensioning member causes the orthotic to deform downwardly. These motions collectively cause the energy return system in accordance with the invention to load.

Figure 3:
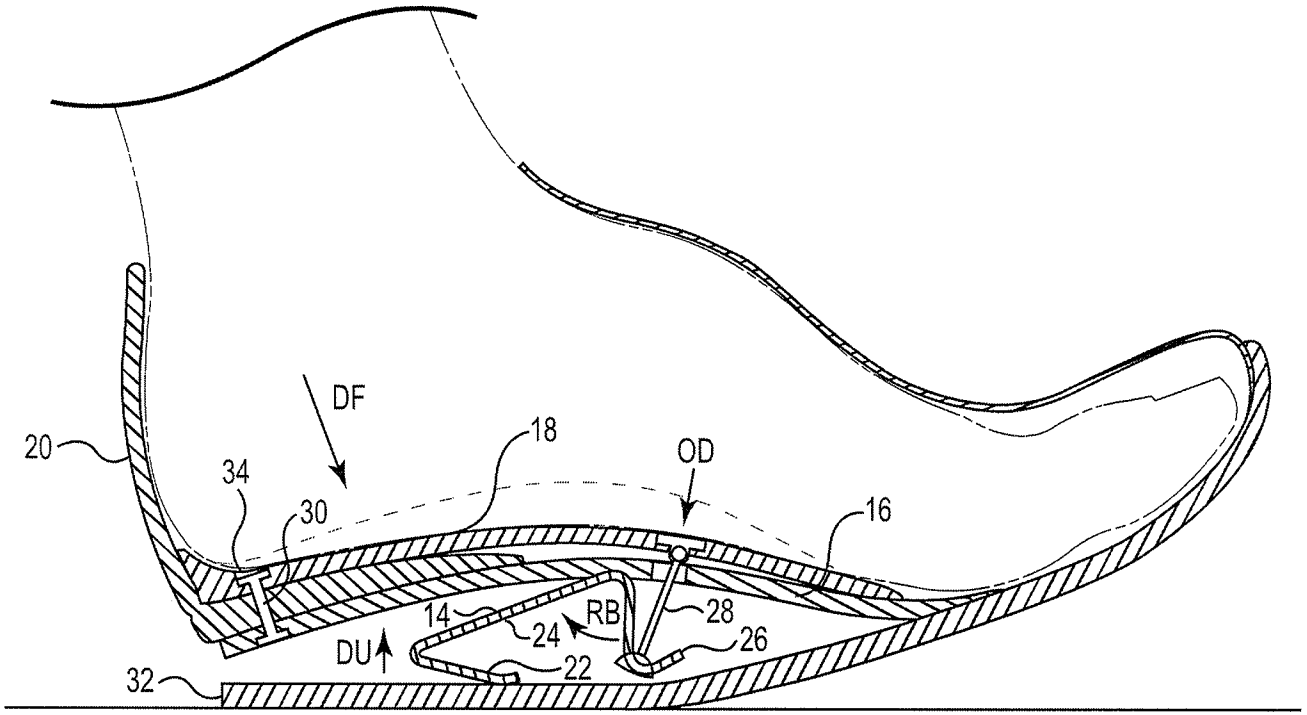
FIG. 3 is a view thereof wherein the foot has advanced in the gait cycle to initial contact with the ground or heel strike.

Referring now to FIG. 3 the downward force of the heel continues to cause base 12 to deform upwardly U toward platen 16. Particularly, angled central portion 24 of lever 14 deforms closer to slide 22 as connecting portion 26 rotates distally RB loading tension member 18 with tension. Tensioning member 18 causes orthotic to continue to move downwardly OD. As can be seen, the arch of the foot is compressed down further than as seen in FIG. 2 and thus more energy is being stored in the orthotic layer 18.

Figure 4:
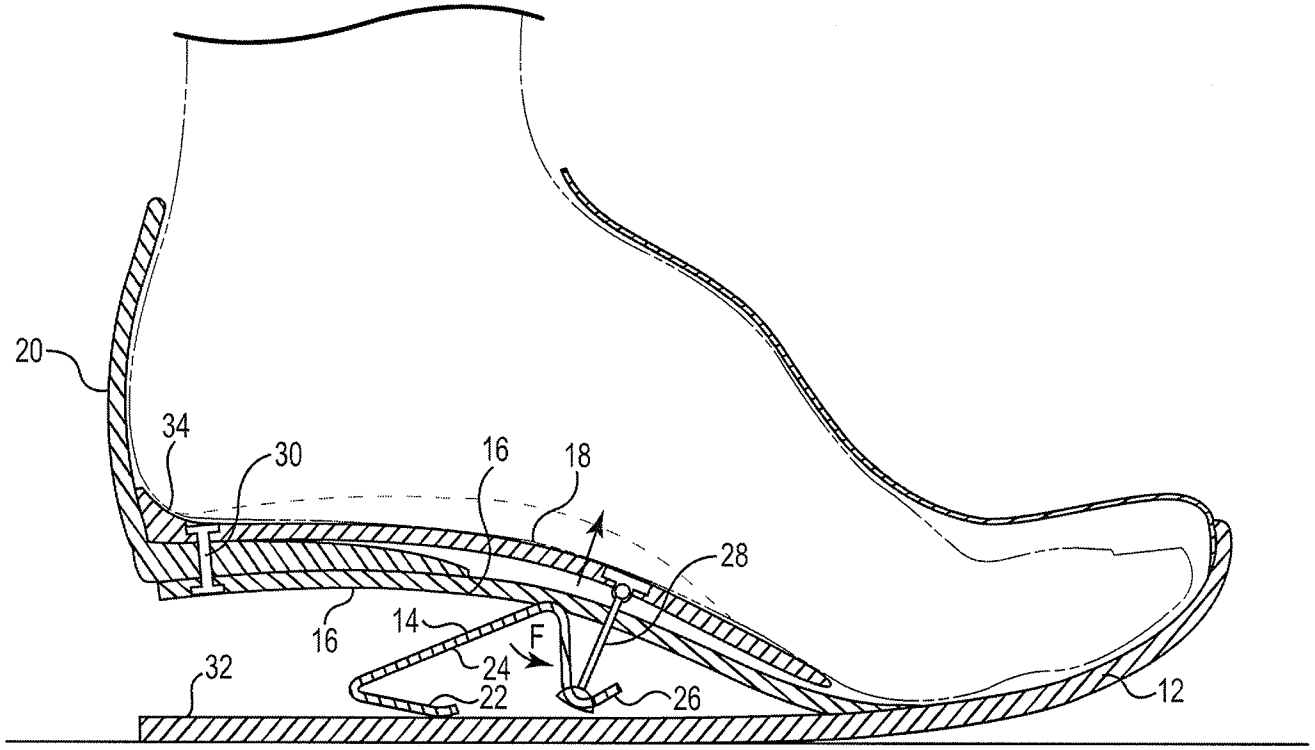
FIG. 4 is a view thereof rebounding from initial contact or heel strike at mid-stance.

Loading response ends with contralateral toe off, when the opposite, second foot leaves the ground (not shown). Mid-stance begins with contralateral toe off and ends when the center of gravity is directly over the reference foot as seen in FIG. 4. This phase, and early terminal stance, are the only times in the gait cycle when the body's center of gravity truly lies over the base of support. Terminal stance begins when the center of gravity is over the supporting foot and ends when the contralateral foot contacts the ground. During terminal stance, the heel rises from the ground.

Referring now to FIG. 4 the foot is shown at mid-stance as it commences to rotate forward and energy stored in the orthotic 18 combined with the previous deformation of the base 12 begins a rebound effect to the foot along the arch. Slide 22 releases partially from base 12 as angled connecting member 26 rotates forwardly F thus starting to release the tension of tensioning member 28 on orthotic 18.

Pre-swing begins at contralateral initial contact and ends at toe off, at around 60 percent of the gait cycle. Thus, pre-swing corresponds to the gait cycle's second period of double limb support. Initial swing begins at toe off and continues until maximum knee flexion (60 degrees) Occurs.

Figure 5:
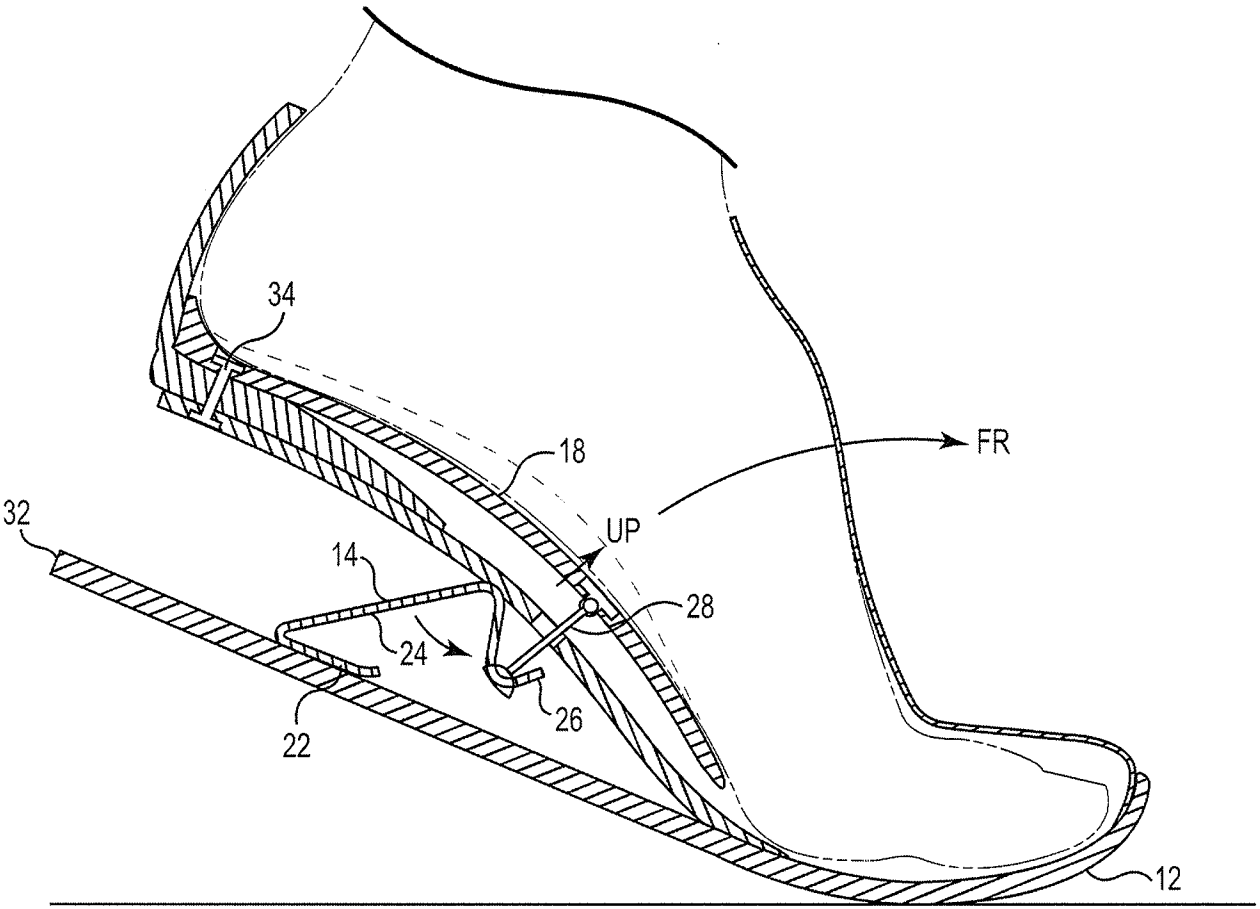
FIG. 5 is a view thereof showing terminal stance with arrow moving toward toe-off or pre-swing phase.

Referring now to FIG. 5 the primary foot is shown at terminal stance moving toward toe-off. In toe-off the foot continues its forward rotation FR and energy stored in the orthotic 18 combined with the base 12 completes the rebounding of energy to the foot along the arch. Downward tension is completely off-loaded from tensioning member 28 and in turn orthotic 18. However, due to the storage of energy in orthotic 18, orthotic 18 presses upwardly UP against arch causing the arch to rise until it reaches the position should in FIG. 1.

Referring again to FIGS. 2-5, the heel strike and the deceleration of the body mass as it impacts the ground will deforms the base 12, flexing it up in the rear, which will then cause lever 14 to lever off the platen 16 and tension the tensioning member 28 which in turn deforms orthotic 18 due to the coupling thereof with tensioning member 28. Orthotic 18 may be coupled in the back (as best seen in FIGS. 2-5) to allow for the tensioning member 18 to dynamically pull the front of the orthotic 18 back towards the fixed point in the rear 34.

Figure 22:
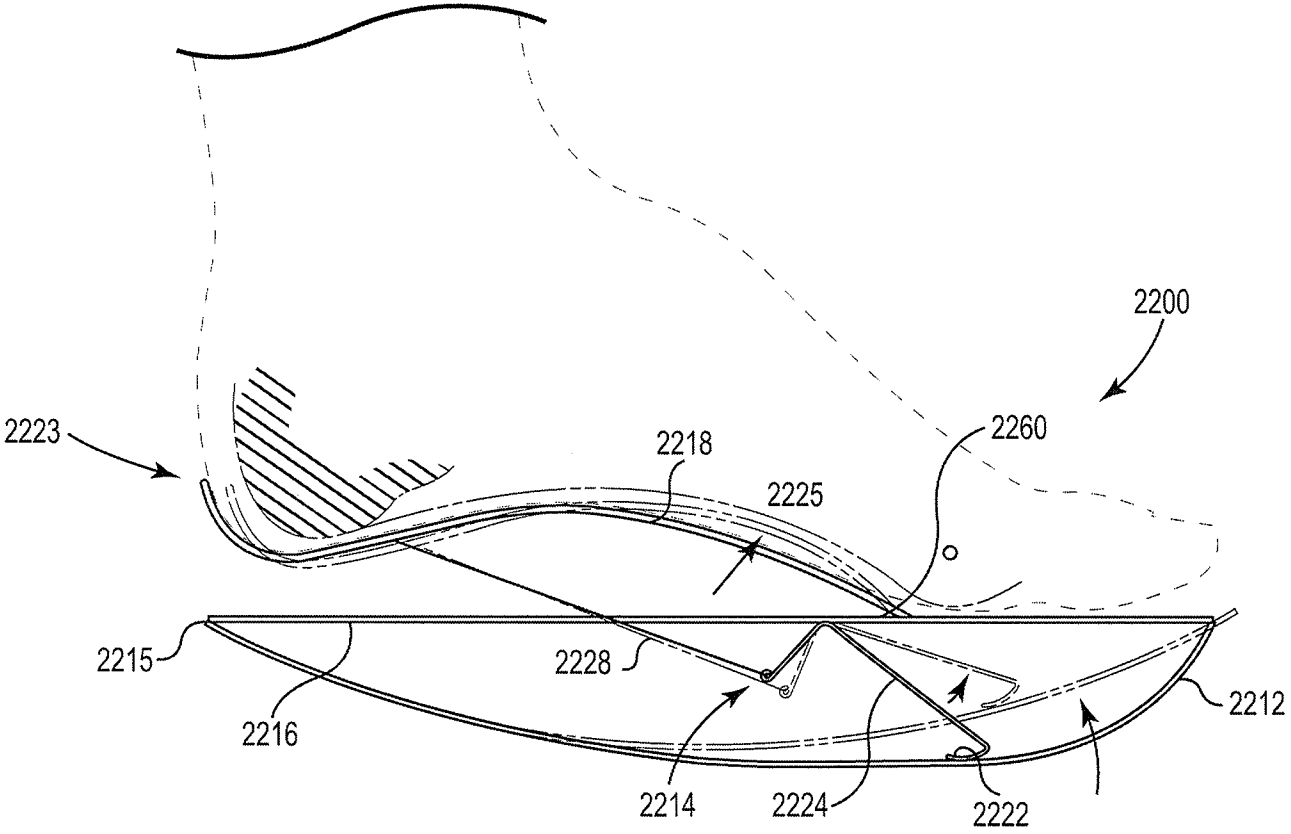
FIG. 22 is a side elevational view of a sixth alternate embodiment of the invention in a static position showing the secondary position of selected elements.

Alternatively, orthotic 18 may be operably coupled to platen 16 at a fixed point in the front (as best seen in FIG. 22). If orthotic 18 is fixed at a front point to platen 16 the leverage from flexion of the front of the sole as it bends up would in turn leverage tensioning member 28 and pull the heel portion of the orthotic 18 forward resulting in the base 12 storing energy.

Thus, the constraint of the base 12 is not controlled; rather it is dynamic in that the stored energy is readily disbursable.

The base layer 12 is not just deflecting the lever. It also absorbs energy and provides shock absorption at heel strike. The stored energy has a tendency to be destabilizing. Thus, the energy return system in accordance with the invention controls the energy to deform the orthotic 18 in such a way that the treatment of particular foot pathologies is possible. In addition, the energy return system is capable of releasing the energy later in the gait cycle by adjusting the location of the lever front to back and by reversing its direction and/or by lengthening the orthotic to perform a particular function.

Figure 31:
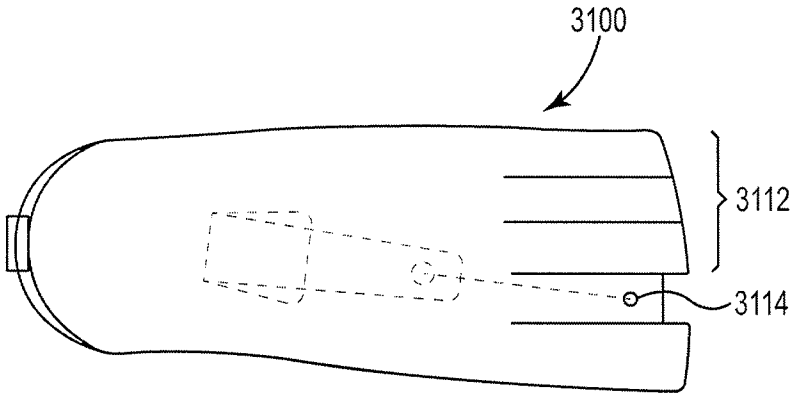
FIG. 31 is a top plan view of an exemplary embodiment of a orthotic in accordance with the invention having all rays segmented.

For example, if one desires to offload an area of excessive pressure such as a diabetic ulcer or a non-union of a fracture (that cannot be loaded when a person is walking otherwise it will cause the fracture to move), the orthotic can be segmented at the front portion (as best seen in alternative embodiment depicted in FIG. 31). Thus, the tensioning member may be manipulated to deform the orthotic at a particular location/segment or in a particular angulation. Alternatively, the arch can be raised to supinate the foot. Still alternatively, if there is a lateral attachment point the foot can be pronated by drawing up the lateral side of the orthotic thus being able to dynamically generate a supination or pronation moment or force while the person is walking.

Further, if the attachment point of the tensioning member 28 to the orthotic 18 was substantially at the middle of the arch the tensioning member 28 would drive the orthotic 18 down and flatten it. Alternatively, if the attachment point of the tensioning member 28 to the orthotic 18 was towards the front of the orthotic 18 the tensioning member 28 would draw the orthotic 18 back and raise the arch. Critical to understanding the forgoing is that the ball of the foot is drawn down into a position closer to contact on the platen, i.e. the plane of support, causing the arch of the foot to carry weight bearing pressure and not the ball of the foot during mid-stance (as seen best in FIG. 13).

Referring again to FIG. 3, it depicts further compression of the energy return system. Thus, the arch of the foot is seen as compressed downwardly even further (than in FIG. 2) and thus more energy is being stored in the orthotic 18. If pathology exists in the forefoot, by way of example an ulcer or a stress fracture or a metatarsal non-union, when the orthotic 18 is once again allowed to elevate, it creates an upward moment or force behind the ball of the foot that will lift and unload the ball as the person is moving toward forefoot loading in which the ball of the foot sustains a great deal of pressure. The lift created right behind the ball of the foot will unload or unweight. FIGS. 1-5 depict a basic energy return system. A lever operably coupled at the front of the orthotic and a lever operably coupled to a back portion of the orthotic have been described. As lever deforms the orthotic layer also deforms. How it deforms, i.e. in which direction and at what angulation, depends primarily in part on the point of attachment of lever 14 as will now be discussed in detail.

Figure 6:
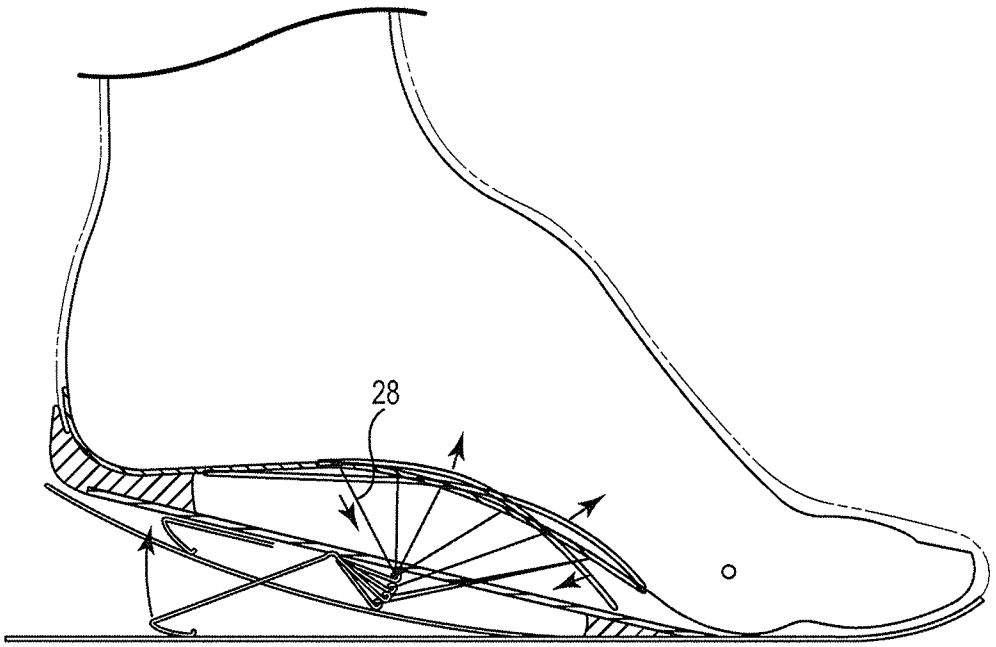
FIG. 6 is a view of the tri-layer orthotic in accordance with the invention showing various attachment points for tensioning member and the effects thereof.
Figure 13:
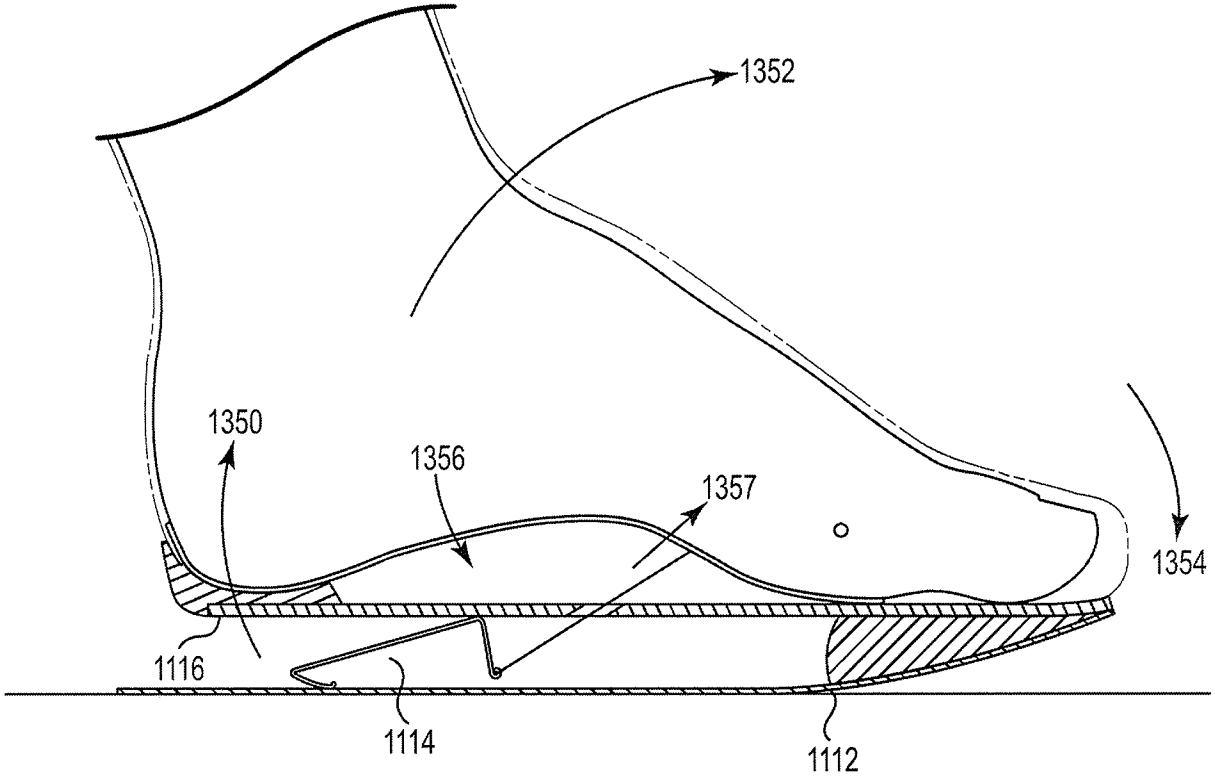
FIG. 13 is a view thereof at mid-stance with arrow showing foot advancing toward terminal stance.

Referring now to FIG. 6 various attachment points on tensioning member 28 and resulting actions are depicted. If the attachment point of the tensioning member 28 to the orthotic 18 is varied, such variation will cause the orthotic 18 to flex in different ways to affect the foot. With a rear attachment of tensioning member 28 to orthotic, the arch of the orthotic 18 is lowered thus reducing ground reactive force between the foot and the orthotic that in the case of posterior tibial dysfunction may make the orthotic intolerable to the patient. This dynamic lowering of ground reactive forces at impact may allow greater biomechanical control to be tolerated by the patient. If the attachment point of the tensioning member 14 to the orthotic 18 is at the front of the orthotic 18, the orthotic arch is raised as best seen in FIG. 13.

In human anatomy, the subtalar joint occurs at the meeting point of the talus and the calcaneus. The subtalar joint allows inversion and eversion of the foot during the gait cycle. Thus, depending on what foot pathology needed treatment, the attachment point of the tensioning member would affection the function of the energy return system. If the attachment point of the tensioning member is placed lateral to the subtalar joint access toward the fifth ray or the lateral aspect of the forefoot, it would have the effect of raising the lateral arch of the orthotic to pronate the foot or tip the foot inward and cause eversion of the subtalar joint. Attachment of the tensioning member medial to the subtalar joint access, by way of example under the first distal ray, would have the effect of raising the medial aspect of the orthotic and would have the effect of causing supination and tip the foot laterally which would invert the subtalar joint. Attachment of the tensioning member to the arch portion of the orthotic would draw the orthotic arch height down to be more flat. This would allow for rebound recoil spring as the lever is unweighted in the back. Drawing the orthotic layer down to the platen and allowing it to rebound back up as the lever is unweighted in the back would create lift proximal to the metatarsal heads or underneath the metatarsal heads if the orthotic is lengthened.

Similarly, the orthotic could be altered in length to affect changes in the foot anatomy. Conventional orthotics terminate behind the ball of the foot to allow for flexion of the ball of the foot. With the tri-layer energy return system of the present invention, the orthotic could be lengthened to be positioned underneath the ball of the foot if unweighting was desired at that area. Moreover, if the orthotic is positioned underneath the metatarsal heads and supported the metatarsal head weight a thrust upward under the ball of the foot could be created increasing vertical energy (as in a jump). Further, the orthotic could also be windowed under an area of an ulcer such that it prevented loading on the ulcer.

Those of skill in the art will appreciate that the flexibility in the base layer 12 and the rocker bottom shape would allow normal gait while controlling dorsiflexion and plantar flexion of the metatarsal phalangeal joint during gait. As noted, flexion of the base layer 12 provides flex energy while also providing shock absorption.

Thus, those of skill in the art will appreciate that the attachment point of the tensioning member to the orthotic and platen can be varied depending of the type of pathology that is being treated and the length and position of the orthotic may also be changed to affect changes in foot anatomy, the foregoing causing the orthotic to act as a leaf spring.

Figure 7:
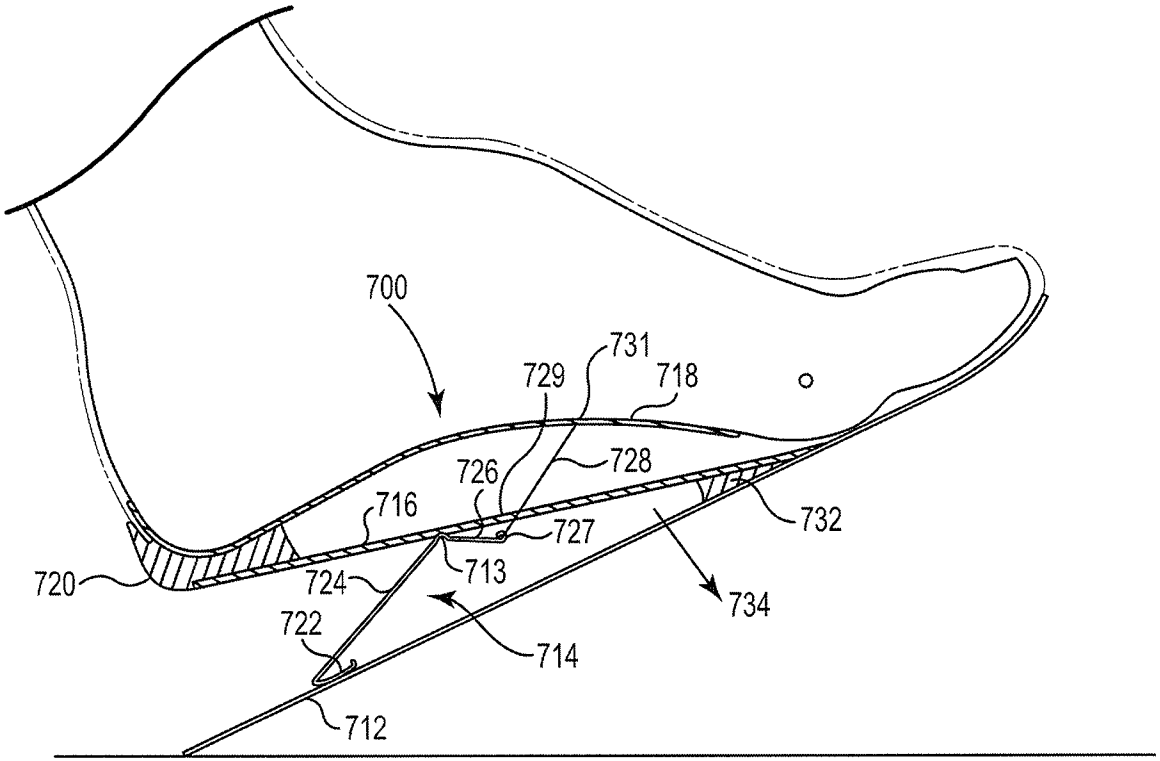
FIG. 7 is a side elevational view of a first alternative embodiment of the invention at the commencement of the gait cycle.

With the foregoing as background, FIGS. 7-10 illustrate a first alternative embodiment of the energy return system 700 in accordance with the invention comprising base layer 712, lever 714, platen 716 and orthotic 718. Functionally, the energy return system 700 of FIGS. 7-10 performs as does the energy return system 10 of FIGS. 1-6. The energy return system 700 illustrated in FIG. 7 is shown at the initial contact with the ground and is incorporated into footwear, brace or the like shown in phantom line. Arrow depicts the normal downward force DF of the foot and the energy return system 700 against a surface at grade. Base 712 may be of any length so long as it generally extends from the sole of the foot to the toe region and may comprise any material used for the soles of shoes including but not limited to rubber, plastics, polymers, polyurethanes and the like. Base 712 is desirably resilient functions as a leaf spring in this alternative embodiment.

Lever 714 includes slide 722, angled central portion 724, fulcrum 725, terminal portion 726 and cable 728. Lever 714 is made from a material that is resilient to allow it to dynamically deform during the gait cycle. Suitable materials that may be utilized for lever 714 include plastics, polymers and resilient metals. Orthotic 718 is also made from a material that is resilient to allow it to dynamically deform during the gait cycle. Suitable materials that may be utilized to construct orthotic 718 include polyolefin; polypropylene; open and closed cell foams and graphites. Platen 716 is desirably made from rigid or semi-rigid materials such as plastics know to those of skill in the art.

Cable 728 operably couples lever 714 at terminal portion 726 to orthotic 718. Platen 716 is desirably rigid or semi rigid and is operably coupled to orthotic 718 through rear gusset 720. Platen 716 is operably coupled to base 712 by front gusset 732. Angled central portion 724 of lever 714 terminates at fulcrum 713. Fulcrum 713 lies adjacent and supports platen 716. Terminal portion 726 includes loop 727 that operably couples cable 728 through pass 729 in platen 716. Cable 728 is coupled to orthotic 718 at attachment point 731 immediately forward of the arch of the foot and thus, indirectly operably couples orthotic 718 and base 712. Cable 728 is depicted as a cable or wire but may also comprise pins, rods, filaments and other structures known to those of skill in the art.

Figure 8:
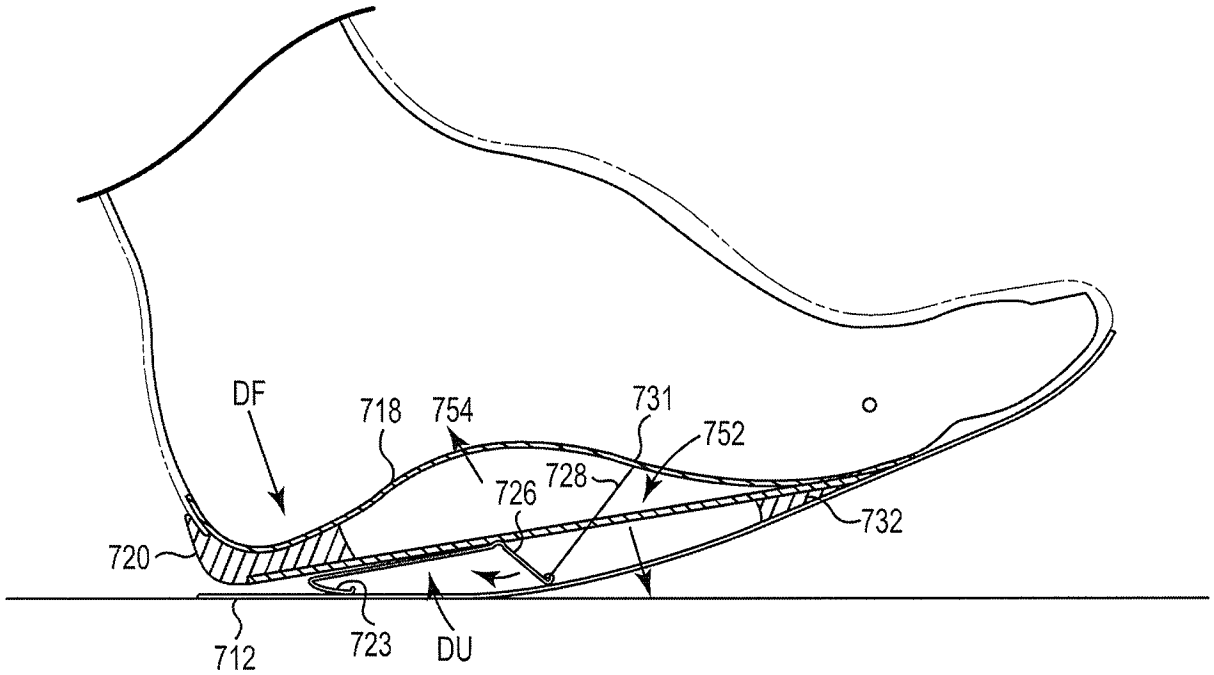
FIG. 8 is a view thereof at heel strike.
Figure 9:
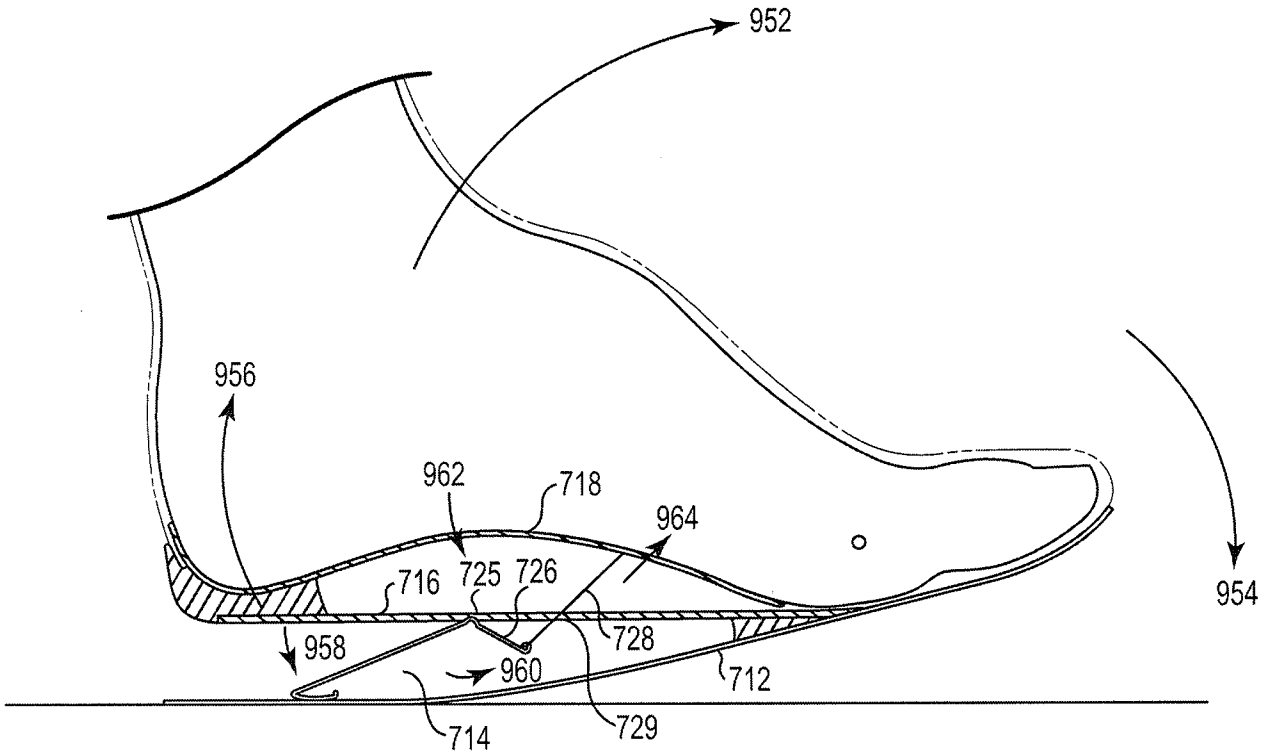
FIG. 9 is a view thereof rebounding from heel strike and moving toward mid-stance.

Referring now to FIG. 8, at heel strike the downward force (DF) of the heel causes base 712 to deform upwardly DU 850 toward platen 716. Slide 722 moves backwards toward heel putting tension on cable 728. Cable 728 thus pulls orthotic 718 away from the ball of the foot 752 causing it to rise against arch 754. Referring now to FIG. 9, the foot is shown as commencing forward rotational motion of the foot 952 toward mid-stance. Downward forces on the heel are released and unloaded 956. This rebound causes lever 714 to move toward its original position 958, 960 releasing energy from orthotic 718 and causing orthotic to flatten against the arch 962 and to thrust forward and upward 964.

Figure 10:
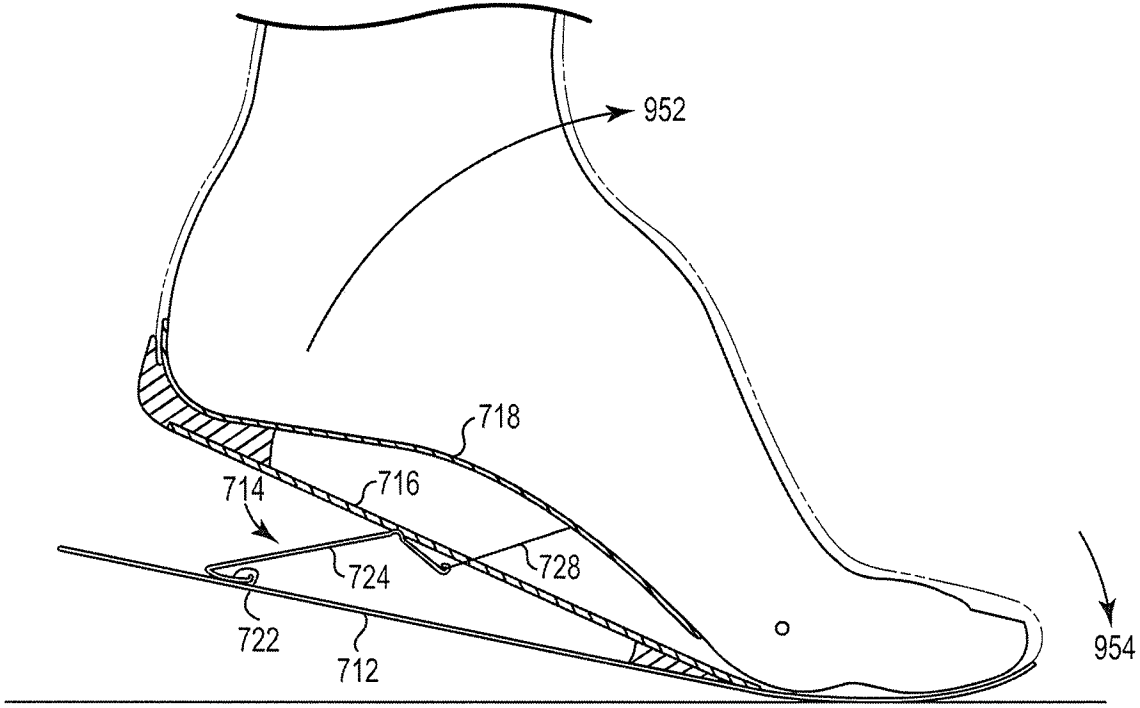
FIG. 10 is a view thereof at terminal stance with foot moving toward toe-off or the pre-swing phase.

FIG. 10 illustrates the foot continuing its normal forward rotational motion toward toe-off 954 with energy unloaded from the energy return system.

FIGS. 11-14 illustrate a second alternative embodiment of the energy return system in accordance with the invention similar to FIGS. 7-10 except cable 1128 is shown operably coupled to orthotic 1118 immediately proximal to the ball of the foot. FIGS. 11-14 again illustrate a part of the gait cycle from the unweighted position, to the loading response at heel strike through toe-off.

Figure 11:
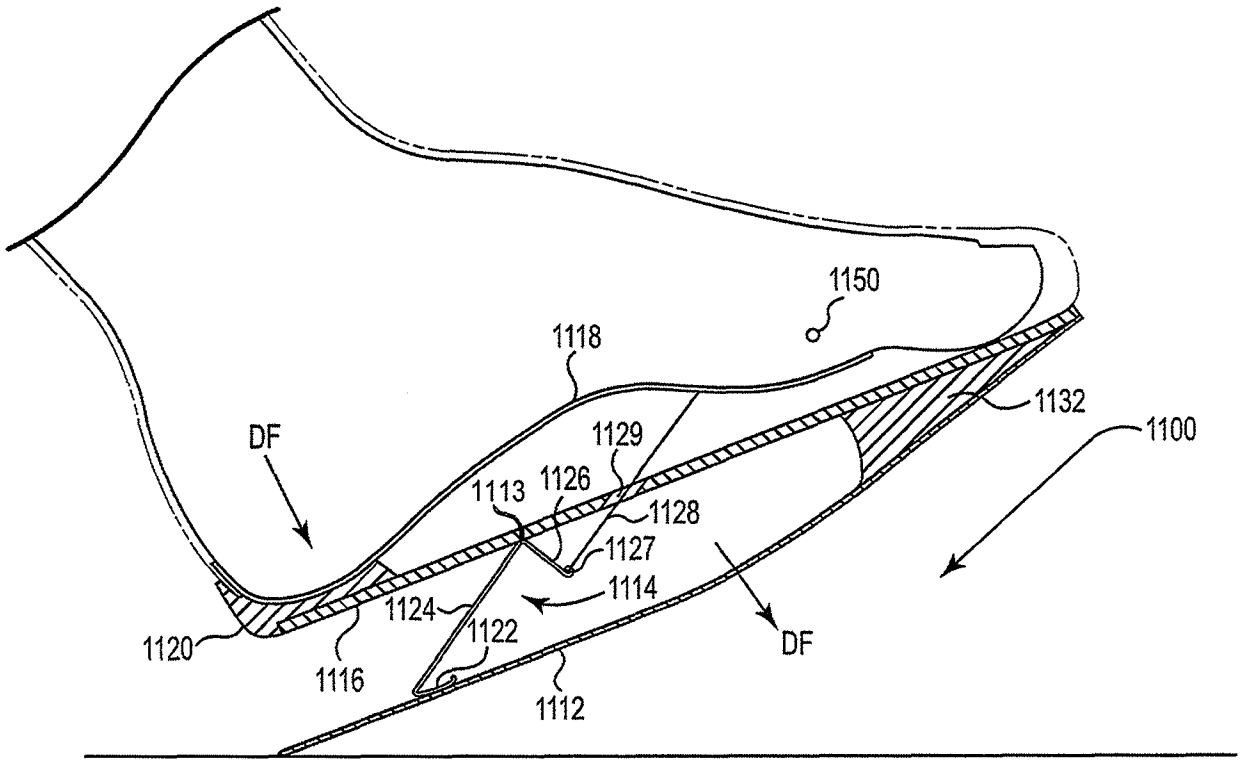
FIG. 11 is a side elevational view of a second alternate embodiment of the invention beginning initial contact with the ground.

Referring now to FIG. 11, like elements are identified with like numerals. The energy return system 1100 in accordance with the invention comprises base 1112, lever 1114, platen 1116 and orthotic 1118. The energy return system 1100 illustrated in FIG. 11 is shown prior to heel strike and is incorporated into shoe shown in phantom line. Arrow depicts the normal downward force DF of the foot and the energy return system 1100 against a surface at grade. Base 1112 may be of any length so long as it generally extends from the sole of the foot to the toe region and may comprise any material used for the soles of shoes including but not limited to rubber, plastics, polymers, polyurethanes and the like. Base 1112 is desirably resilient functions as a leaf spring in this alternative embodiment.

Lever 1114 includes slide 1122, angled central portion 1124, fulcrum 1125, terminal portion 1126 and cable 1128. Lever 1114 is made from a material that is resilient to allow it to dynamically deform during the gait cycle. Suitable materials that may be utilized for lever 1114 include plastics, polymers and resilient metals. Orthotic 1118 may also made from a material that is resilient to allow it to dynamically deform during the gait cycle. Suitable materials that may be utilized to construct orthotic 1118 include polyolefin; polypropylene; open and closed cell foams and graphites. Platen 1116 is desirably made from rigid or semi-rigid materials such as plastics known to those of skill in the art.

Cable 1128 operably couples lever 1114 at terminal portion 1126 to orthotic 1118. Platen 1116 is desirably rigid or semi rigid and is operably coupled to orthotic 1118 through rear gusset 1120. Platen 1116 is operably coupled to base 1112 by front gusset 1132. Angled central portion 1124 of lever 1114 terminates at fulcrum 1113. Fulcrum 1113 lies adjacent and supports platen 1116. Terminal portion 1126 includes loop 1127 that operably couples cable 1128 through pass 1129 in platen 1116. Cable 1128 is coupled to orthotic 1118 at attachment point 1150 immediately proximal the rotation axis of the ball of the foot and thus, operably couples orthotic 1118 and platen 1116. Cable 1128 is depicted as a cable or wire but may also comprise pins, rods, filaments and other structures known to those of skill in the art.

Figure 12:
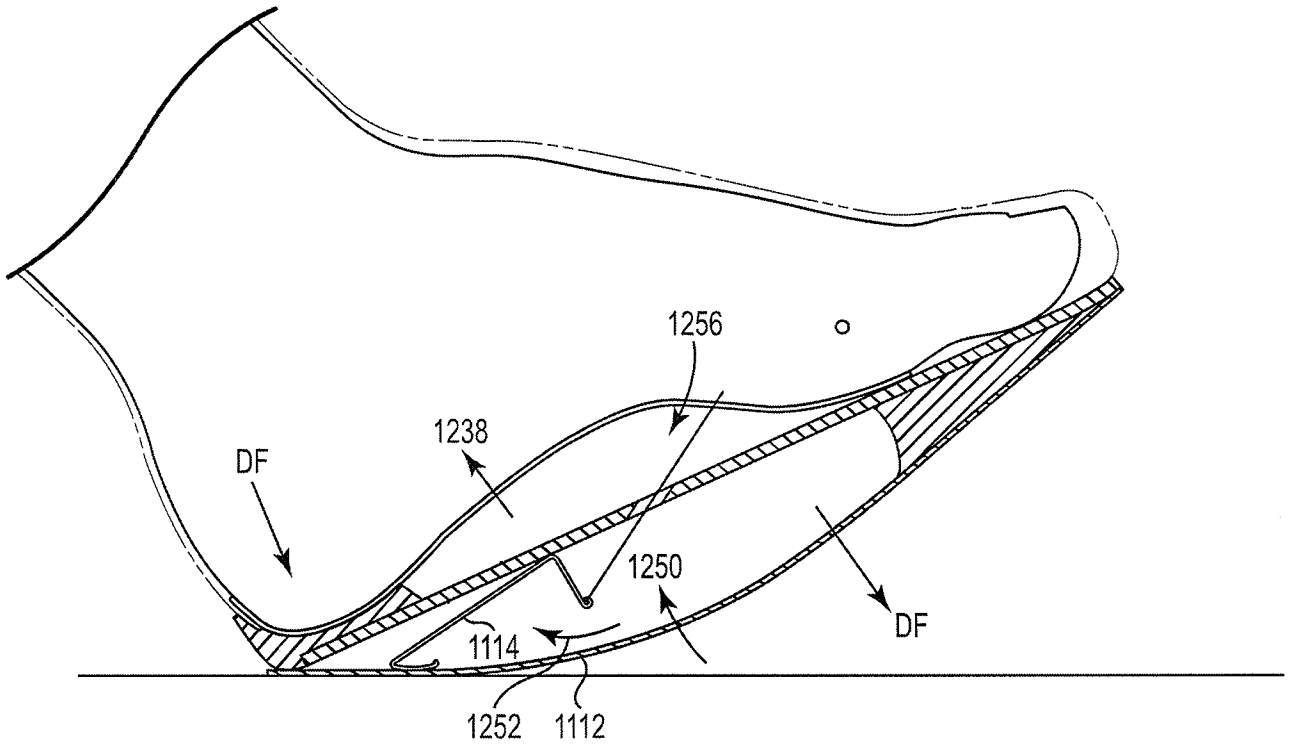
FIG. 12 is a view thereof at full initial contact with the ground.

Referring now to FIG. 12, downward forces at heel strike cause base 112 to deform upwardly toward the heel 1250 causing lever 1114 to slide proximally 1252. As lever continues sliding proximally tension is put on cable 1128 drawing orthotic 1118 rearward 1256 away from the ball of the foot and upward against the arch of the foot 1258.

FIG. 13 depicts the unloading 1350 of the base 1116 and the forward unloading motion 1352, 1354 of the foot as it moves from mid-stance toward toe-off position. The unloading motion transmits rebound energy to the system allowing lever 1114 to commence returning to original position. The rebound energy propels heel upward and forward while flattening 1356 orthotic 111 against arch and to thrust forward 1357.

Figure 14:
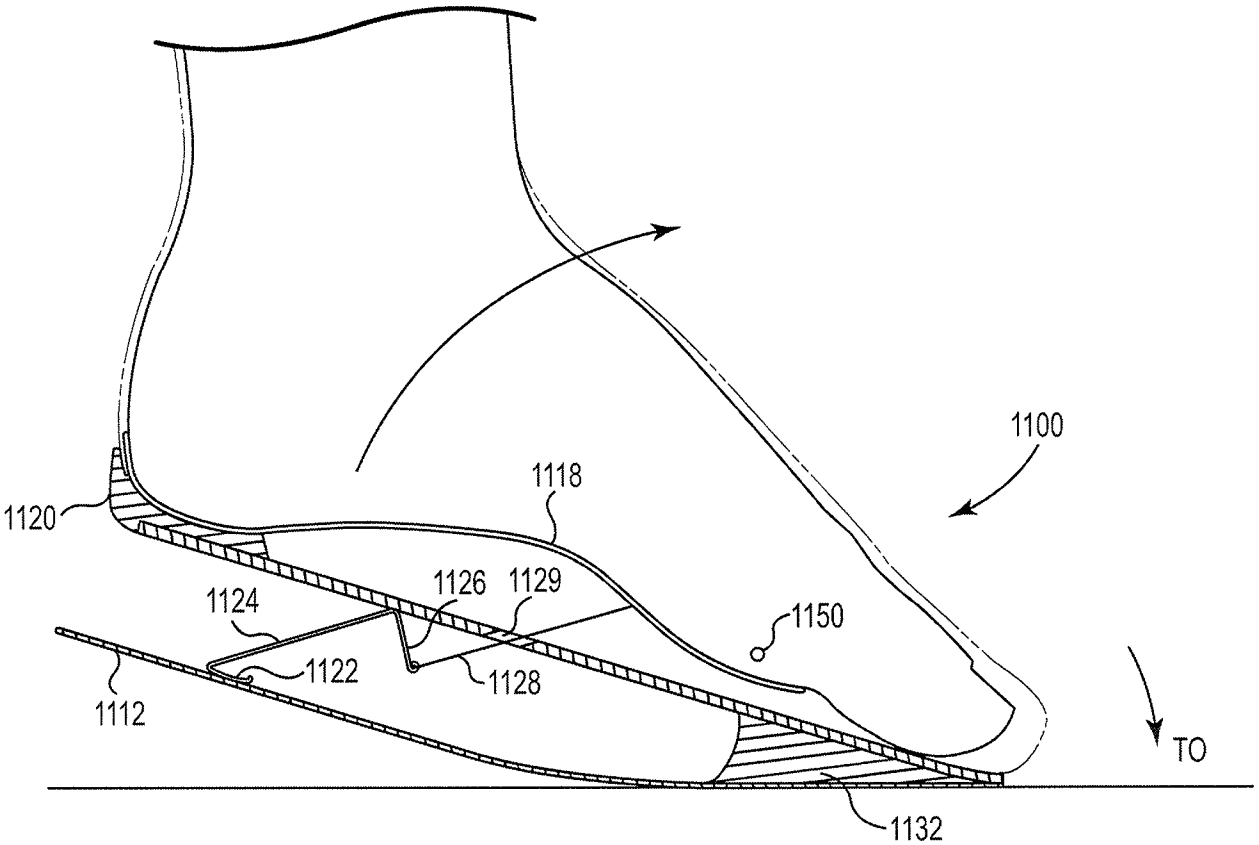
FIG. 14 is a view thereof near pre-swing.

FIG. 14 illustrates the forward thrusting of the foot toward toe-off and the continuing rebound due to the release of energy from the energy return system in accordance with the invention. Thus, the embodiment depicted in FIGS. 11-14 is designed to address forefoot pressures and operates with limited MPJ dorsiflexion. Thus, stress fractures, metatasalgia and foot ulcers and other types of dysfunctions may be treated.

Figure 15:
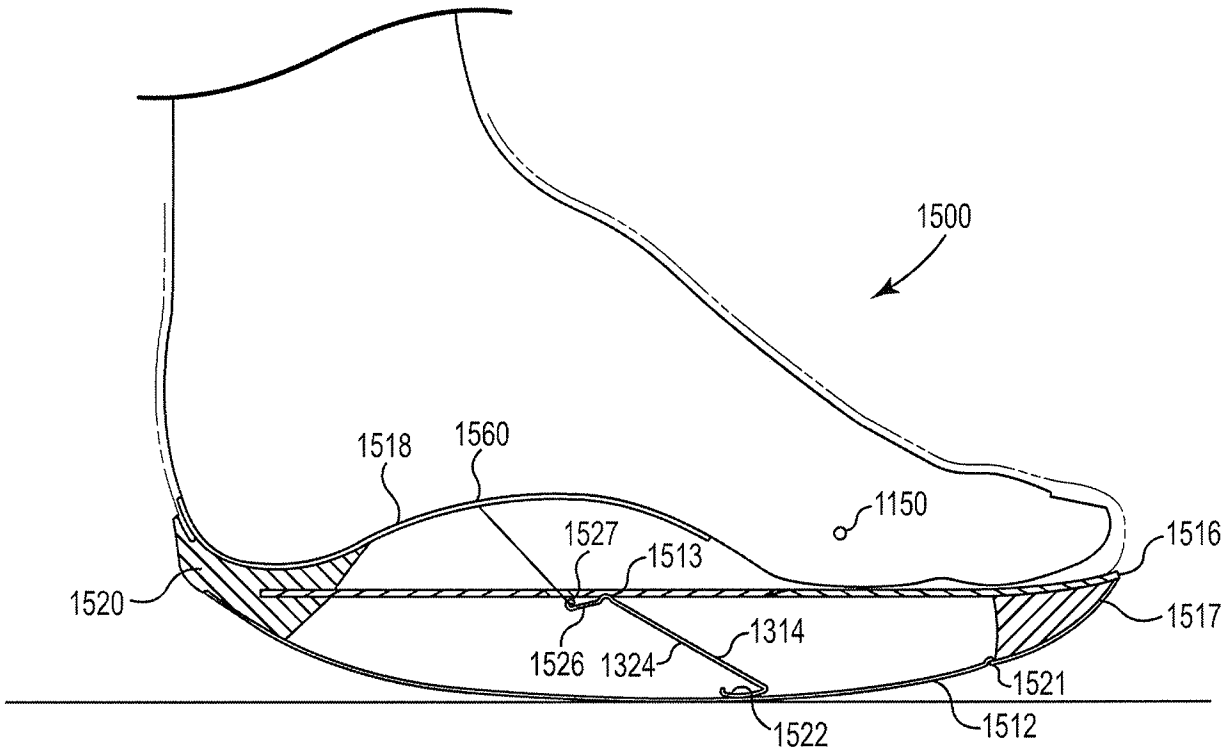
FIG. 15 is a side elevational view of a third alternate embodiment of the invention shown on an equines patient in the unburdened position.
Figure 16:
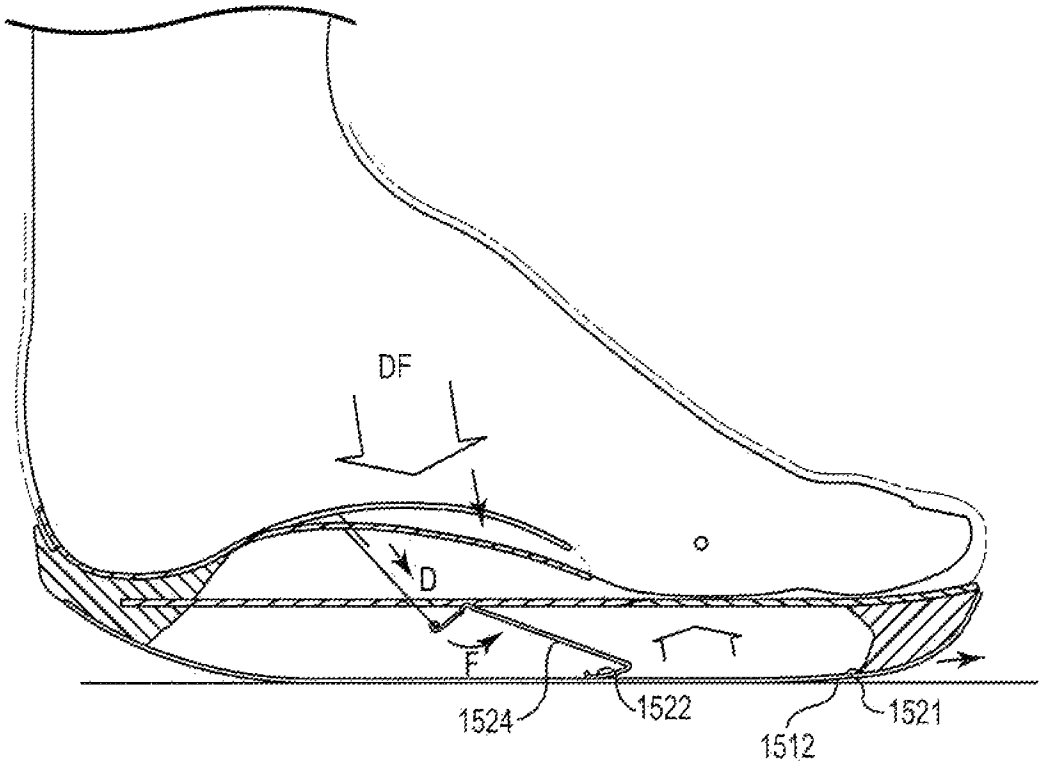
FIG. 16 is a view thereof in a position toward loading.
Figure 17:
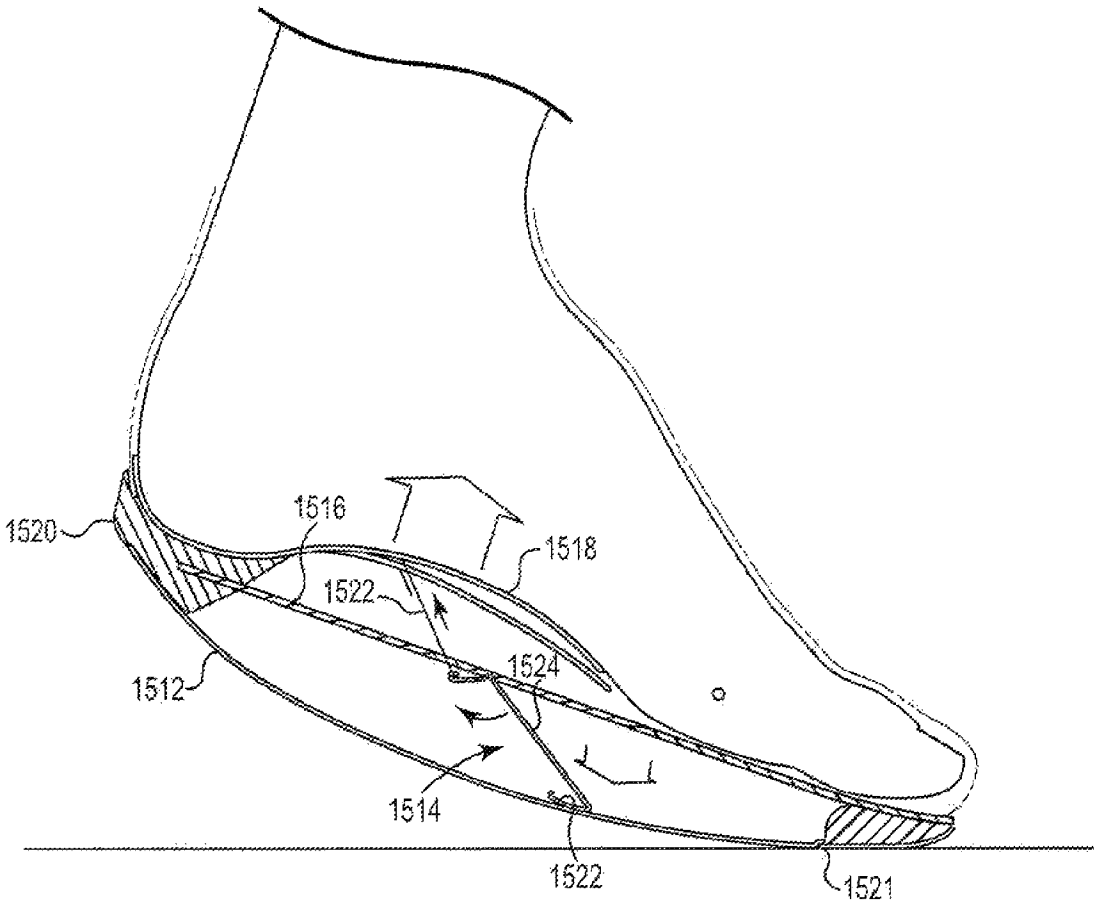
FIG. 17 is a view thereof at toe impact.
Figure 18:
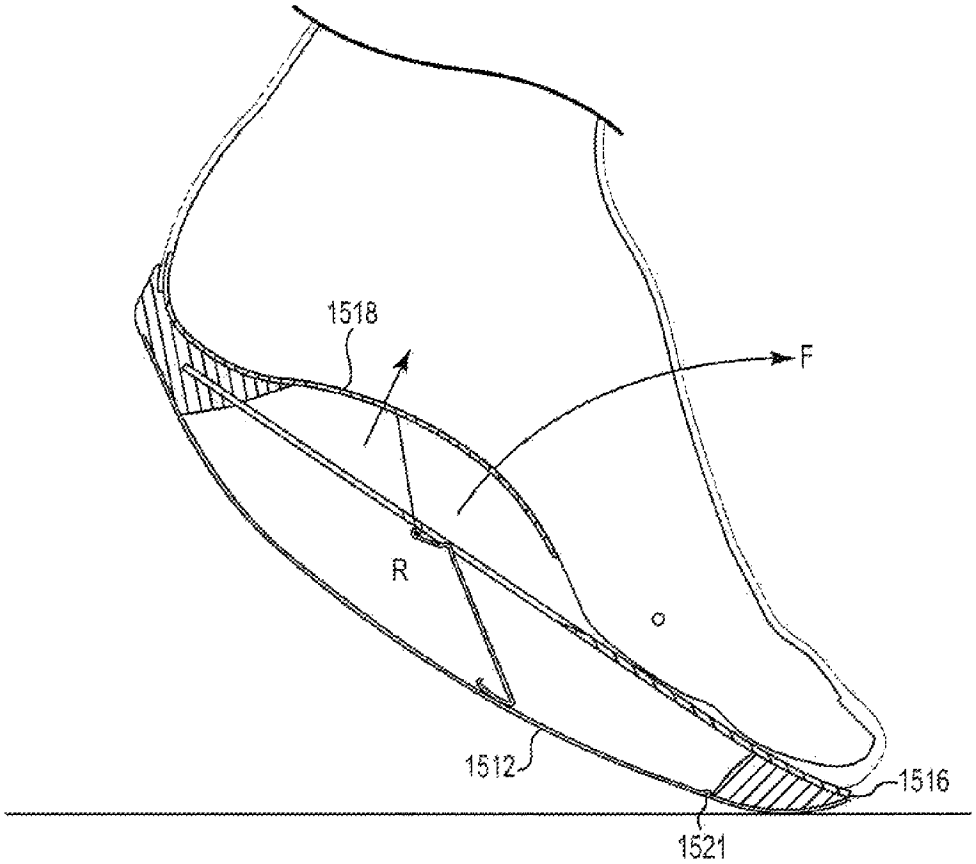
FIG. 18 is a view thereof at completion of toe impact.

Referring now to FIGS. 15-18 a third alternative embodiment in accordance with the energy return system 1500 of the present invention is illustrated. Particularly, lever 1514 is inverted and designed to operate differently than previously described embodiments. As can be seen the attachment point 1560 of cable 1528 is at a point proximal to the mid-arch. In addition rear gusset operably couples base 1512 with platen 1516 and orthotic 1518. Platen 1516 is also operably coupled to base 1512 at the forefoot by compressible tip 1517. As can be seen in FIGS. 15-16 compressible tip includes a hook 1521 that allows base 1512 to uncouple due to compressive ground forces as the foot moves toward toe-off and recouple when no compressive forces are present. FIG. 15 depicts the energy return system in the unburdened profile or in other words at rest. Referring to FIG. 16, downward force DF creates systematic collection of potential energy by compressing resilient leaf spring-like base 1512. Angled central portion 1524 of lever 1514 rotates forward as cable 1528 pulls orthotic 1518 downward D away from arch. The flattening of orthotic 1528 presses the distal edge of orthotic forward and compressible tip 1517 bulges forward. As best seen in FIG. 17 as the foot nears toe-off, energy is further absorbed as base 1512 continues to flatten and rotates lever 1514 to continue drawing orthotic 1518 to flatten while the distal edge of orthotic moves forward and the ball of foot begins to lift. As best seen in FIG. 18, as the foot is raised and rotated forward F toward toe-off the base 1512 and flattened orthotic 1518 release stored energy causing angled central portion 1524 of lever 1514 to move rearward which releases the tension on cable 1528 and orthotic 1518. Orthotic 1518 returns or rebounds to support the arch of foot.

The embodiment depicted in FIGS. 15-18 is designed for the treatment of equines (toe runners with no heel strike) in which limited dorsiflexion at the ankle causes pathology. Equines is the primary cause of ulcers in diabetic equines patients.

Figure 19:
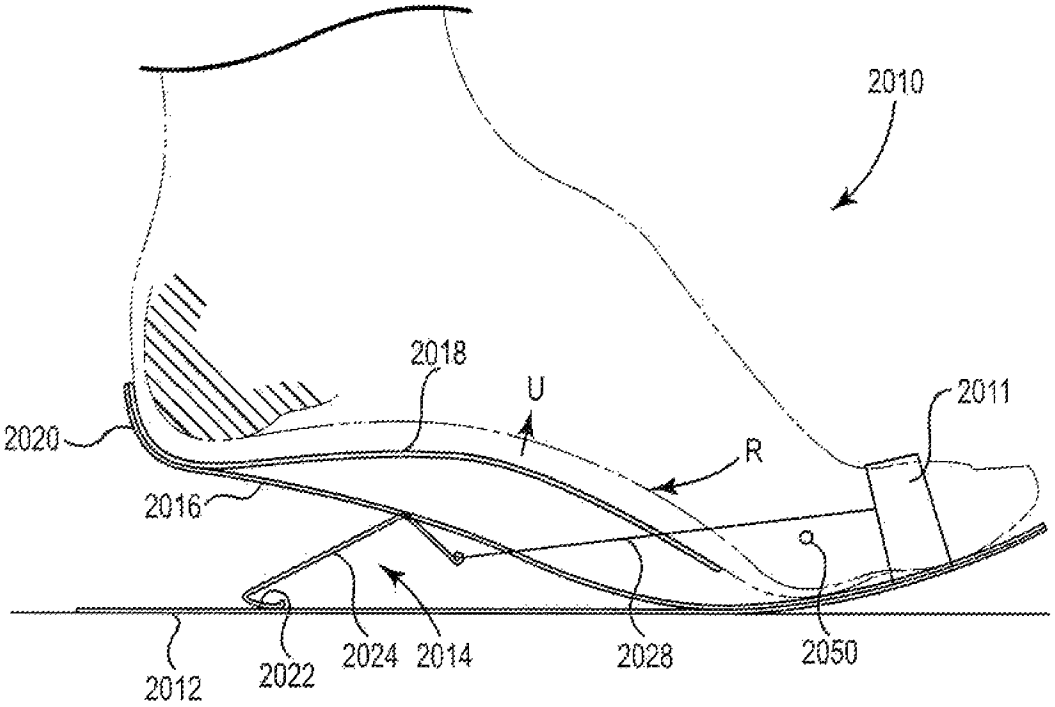
FIG. 19 is a side elevational view of a fourth alternate embodiment of the invention with the foot depicted in a static unburdened position.

FIG. 19 depicts a fourth alternative embodiment 2010 of the energy return system with the foot depicted in a static unburdened position. Like elements are labeled with like numerals. Particularly, orthotic 2018 is attached to platen 2016 at the rear of the foot 2020. Base 2012 is attached to platen 2016 underneath the ball of the foot 2029. Band 2011 surrounds the phalanges and the cable 2028 is attached to the band. As platen 2016 flattens, lever 2014 functions to drawn arch up U. Orthotic 2018 moves rearward R and upward U against the arch when downward force is applied to the ground during the gait cycle. This embodiment is designed to treat plantar fascia.

Figure 21:
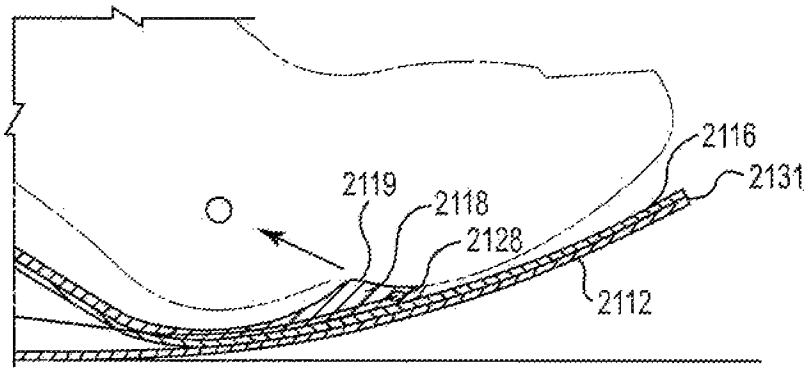
FIG. 21 is an enlarged detail taken from the area 21A of FIG. 20.
Figure 20:
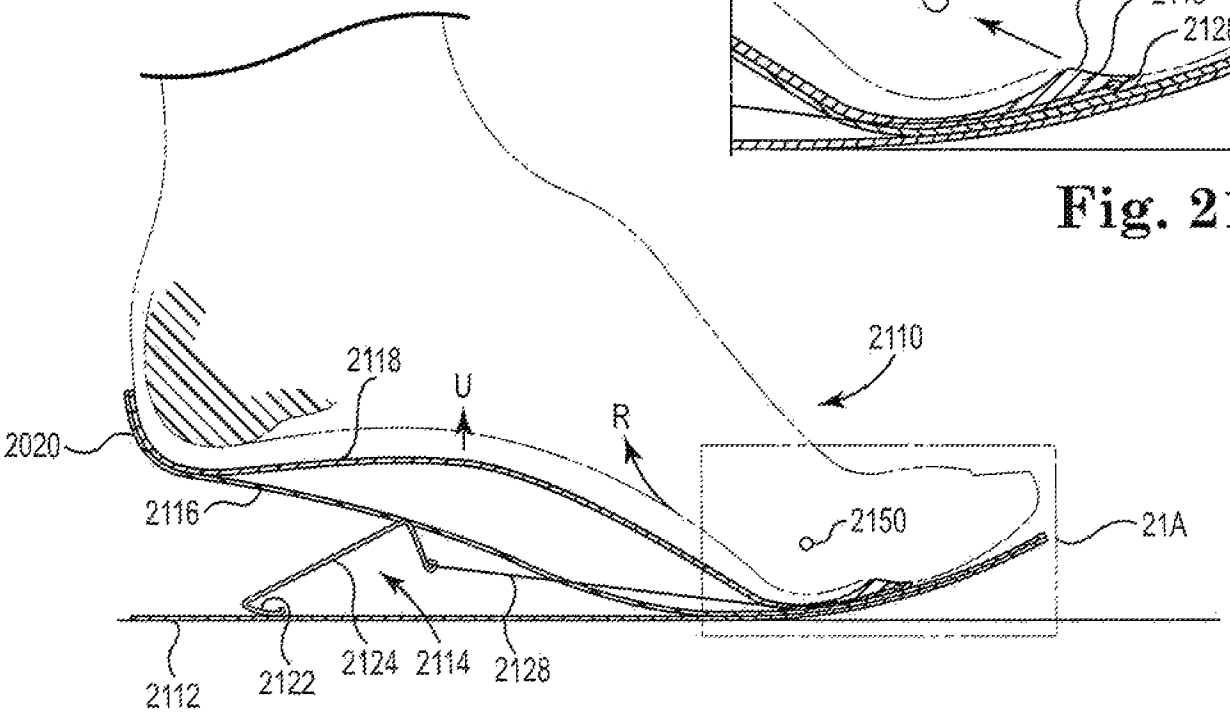
FIG. 20 is a side elevational view of a fifth alternate embodiment of the invention shown in a static unburdened position.

FIGS. 20 and 21 depict a fifth alternative embodiment 2110 of the energy return system in accordance with the invention designed to treat plantar fasciitis. Like elements are labeled with like numerals. Base 2112 is attached to platen 2116 behind heel at 2120. As best seen in FIG. 21, orthotic 2118 is modified to form a cup that cradles sulcus 2119 thus allowing the foot to roll forward during gait without restriction. Cable 2128 is coupled to orthotic 2118 slightly forward of sulcus 2019. Base 2112 and platen 2116 are coupled underneath the ball of the foot 2129 through to tip 2131. Lever 2114 will thus draw the orthotic 2118 rearward R and upward U against the arch and draws the sulcus rearward when downward force is applied to the ground during the gait cycle.

FIG. 22 depicts a sixth alternative embodiment of the invention. The orthotic is fixedly attached at the distal end to platen 2260 and free at the proximal end. As can be seen, orthotic is cupped around heel. The base layer 2212 is fixedly attached 2215 at the proximal end to platen 2216. Cable 2228 is attached to orthotic 2218 underneath the sole of the foot. In this embodiment as the user propels through the gait cycle, the orthotic 2218 will be drawn forward 2223 while lifting 2225 beneath the arch giving support to the plantar fascia.

Figure 23:
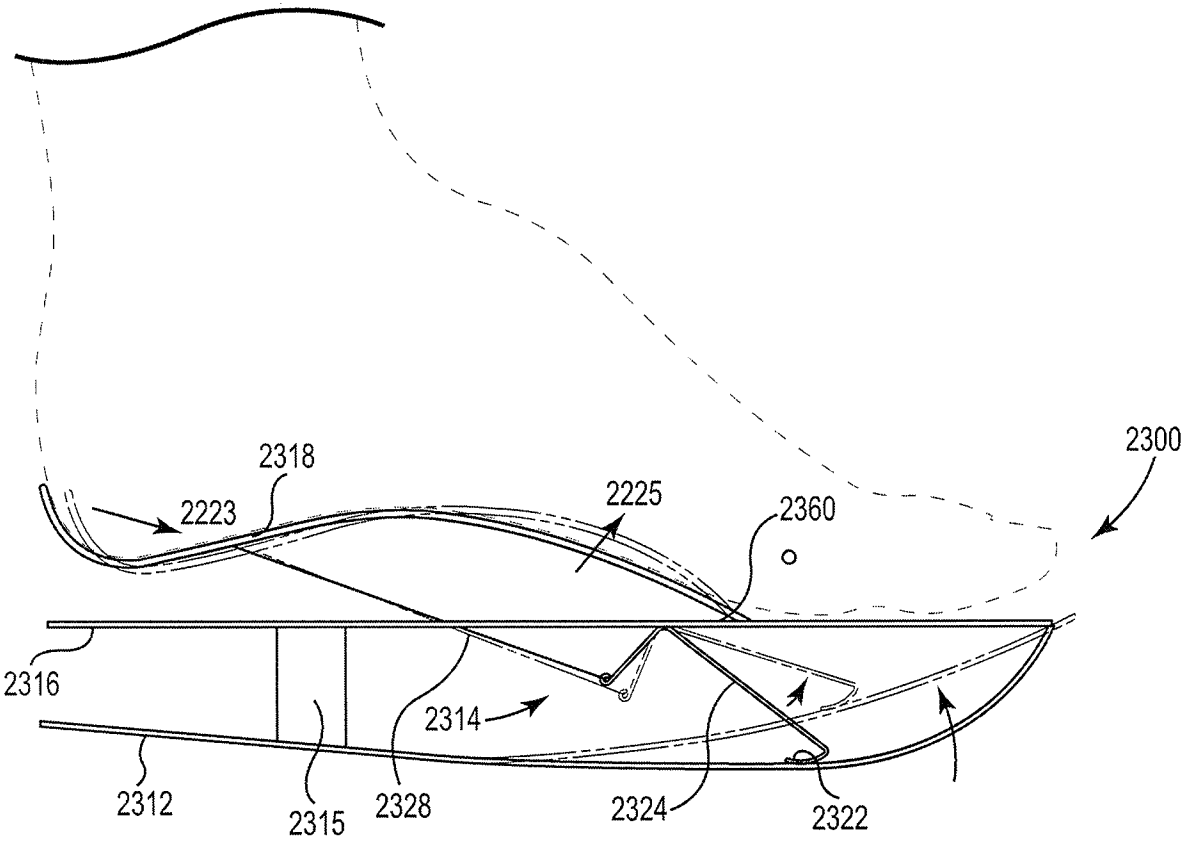
FIG. 23 is a side elevational view of a seventh alternate embodiment of the invention showing the secondary position of selected elements.

FIG. 23 depicts a seventh alternative embodiment of the energy return system in accordance with the invention. Like features have like numerals. As can be seen, orthotic 2318 is fixedly attached 2360 at the distal end to platen 2316. Orthotic 2318 is cupped around the heel of the foot. The proximal end of orthotic 2318 is free. Base 2312 is fixedly attached to platen 2316 by spacer or bridge 2315, which mitigates ground reactive forces. Cable 2328 is attached to orthotic slightly forward of the heel. In operation, as the foot moves through the gait cycle, the orthotic 2318 is drawn forward 2223 while lifting the arch upward 2225 giving support to the plantar fascia.

As discussed previously, in human anatomy, the subtalar joint occurs at the meeting point of the talus and the calcaneus. The subtalar joint allows inversion and eversion of the foot during the gait cycle. Thus, depending on the particular foot pathology needing treatment, the attachment point of the tensioning member would affect the function of the energy return system.

Figure 26:
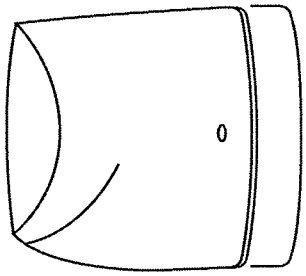
FIG. 26 is a front elevational view thereof showing the secondary position.
Figure 24:
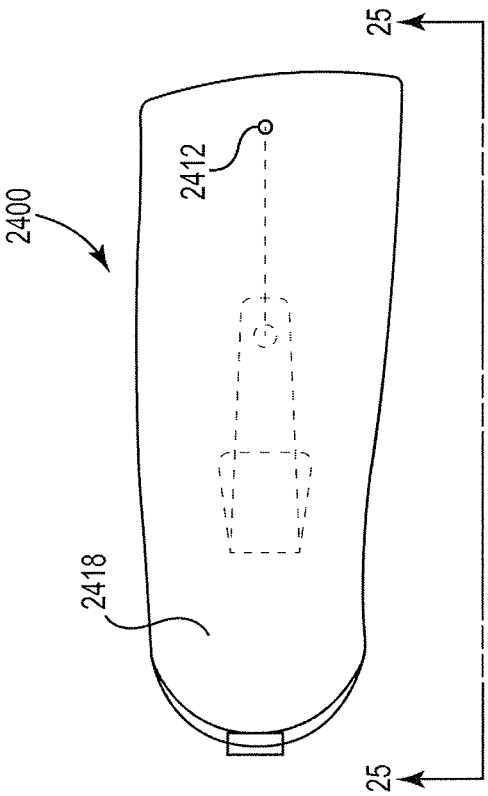
FIG. 24 is top plan view of an exemplary embodiment of an orthotic in accordance with the invention.
Figure 25:
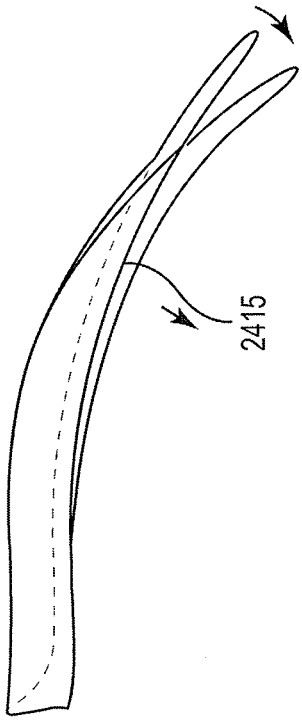
FIG. 25 is a side elevational view taken along line 25-25 of FIG. 24 showing a secondary position.

Tensioning member is attached to the orthotic underneath the arch portion. Thus the tensioning member would draw the orthotic arch height down to be more flat. This would allow for rebound recoil spring as the lever is unweighted in the back. Drawing the orthotic layer down to the platen and allowing it to rebound back up as the lever is unweighted in the back would create lift proximal to the metatarsal heads or underneath the metatarsal heads. Referring now to FIGS. 24-26 attachment point 2412 of tensioning member is underneath the arch portion of the orthotic 2418. As can best be seen in FIG. 25, the tensioning member is flattening orthotic 2418 downwardly 2415 thus creating lift proximal to the metatarsal heads or underneath the metatarsal heads.

Figure 27:
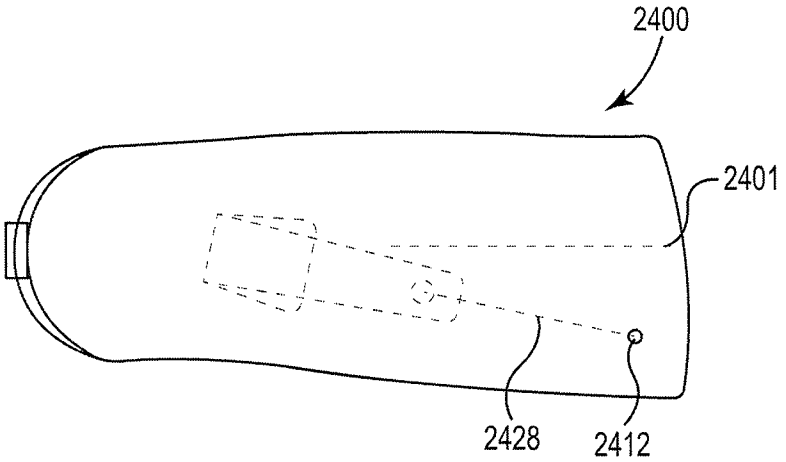
FIG. 27 is a top plan view of a first variation of the subject of FIG. 24 wherein the orthotic is segmented laterally.
Figure 28:
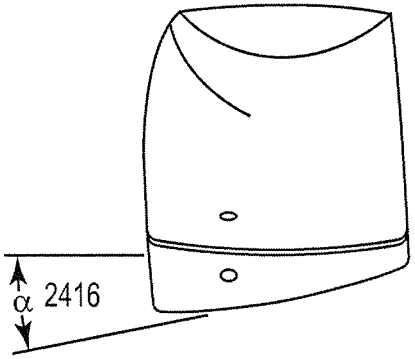
FIG. 28 is a front elevational view thereof showing a secondary position and the angle of correction.

Referring now to FIGS. 27-28 orthotic 2400 is depicted with a segment or cut 2401 on the lateral side of orthotic 2400. Attachment point 2412 of tensioning member 2428 is medial to the subtalar joint access, distally under the first ray. In operation, the tensioning member 2128 causes orthotic 2400 to rotate downward 2414 on the medial side of the orthotic by therapeutic angle 2416 increasing forefoot varus dynamically having the effect of raising the medial aspect of the orthotic arch and would have the effect of causing supination and tip the foot laterally which would invert the subtalar joint.

Figure 30:
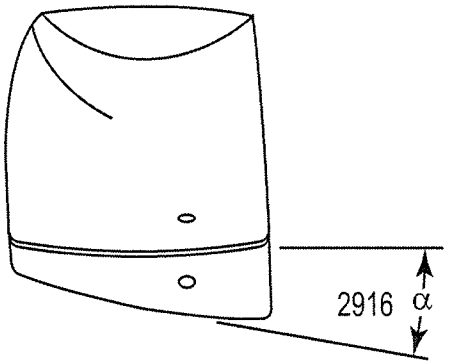
FIG. 30 is a front elevational view thereof showing a secondary position and the angle of correction.
Figure 29:
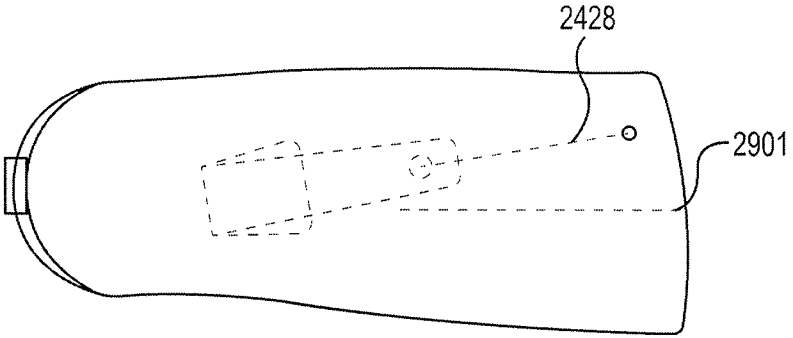
FIG. 29 is a top plan view of a second variation of the subject of FIG. 24 wherein the orthotic is segmented medially.
Figure 33:
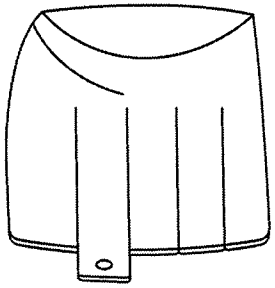
FIG. 33 is a front elevational view thereof showing the secondary position.

If the attachment point of the tensioning member is placed lateral to the subtalar joint access toward the fifth ray or the lateral aspect of the foot, it would have the effect of raising the lateral aspect of the orthotic arch to pronate the foot or tip the foot inward and cause eversion of the subtalar joint. FIGS. 29-30 illustrate orthotic 2900 with segment or cut 2901 on the lateral side of the orthotic 2900 and tensioning member 2428. Tensioning member 2428 is attached to orthotic 2900 laterally at attachment point 2912. In this position, tensioning member 2428 causes orthotic 2900 to rotate downward on the lateral side by therapeutic angle 2916 increasing forefoot valgus dynamically having the effect of causing pronation and tipping the foot medially.

Figure 32:
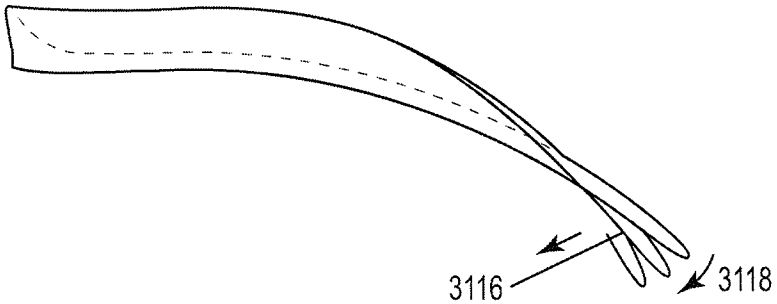
FIG. 32 is a side elevational view thereof similar to that of FIG. 25 showing a secondary position.

Referring now to FIG. 31-32 an orthotic 3100 with a segmented digit array 3112 is depicted. The orthotic includes a tension attachment point 3114 on a selected digit array. In operation the selected digit 3112 of orthotic 3100 is pulled downward 3116 by therapeutic angle 3118 to achieve the remedial therapeutic goal of dynamic offloading of the metatarsals. For example, if the attachment point is on the first segmented ray dynamic offloading of the first metatarsal-phalangeal joint occurs to treat Hallux Limitus. If the attachment point is on the second ray stress fractures, matasalgia and the like are treated. Those of skill in the art will appreciate that the attachment point of the tensioning member may be attached to any ray of the segmented orthotic to result in dynamic off-loading of a particular metatarsal.

Those of skill in the art will appreciate that the segmented orthotic described herein in not limited as to which how the orthotic is segmented or which ray the tensioning member is attached to. Rather depending on the particular foot pathology that needs correction any segment or the orthotic can be made and the tensioning member may be attached to any ray. For example, it is anticipated that two parallel cuts could be made in the orthotic while the tensioning member is attached to the second ray making the second ray dynamic.

Figure 34:
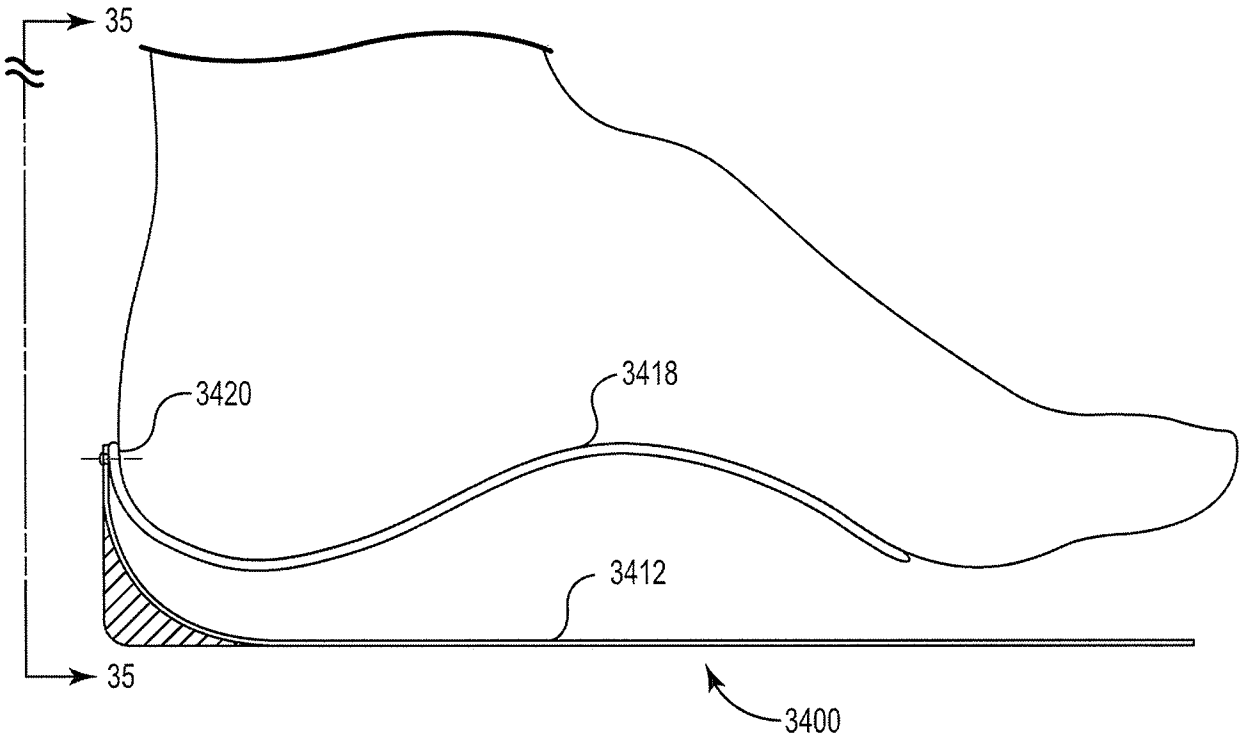
FIG. 34 is a side elevational view of a bi-layer orthotic in accordance with an embodiment of the invention with parts omitted for clarity.

FIGS. 34-41 depict a bi-layer orthotic in accordance with the invention with a cushioning layer between orthotic 3400 and base layer 3412 omitted for clarity. FIG. 34 is a side elevational view of a bi-layer orthotic 3400 in accordance with an embodiment of the invention. As can be seen base layer 3412 is operably coupled to orthotic at the heel of the orthotic by off axis rotator axel 3420. Off axis rotator axel 3412 is pivotally received by base layer 3412 and orthotic 3418 so that orthotic 3418 pivots relative to the base 3412.

Figure 35:
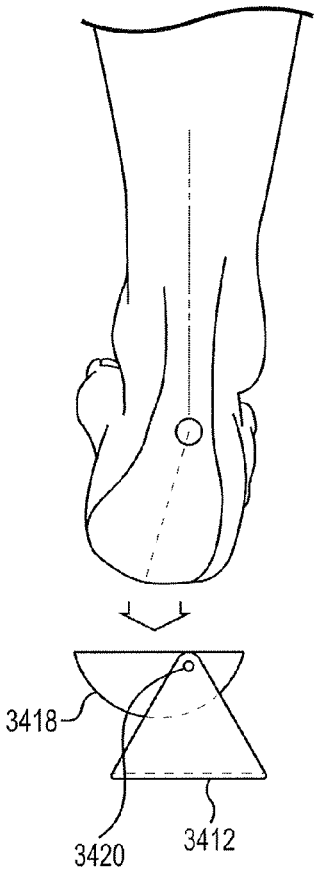
FIG. 35 is a rear elevational view of the bi-layer orthotic of FIG. 34 taken along line 35-35 and showing a pronated foot requiring correction descending into the bi-layer orthotic.
Figure 36:
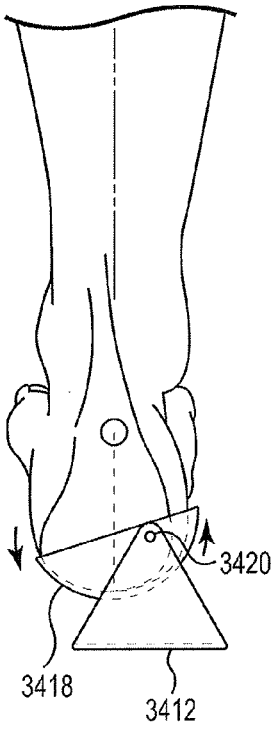
FIG. 36 is a rear elevational view thereof showing the therapeutic correction of a pronated foot.

FIG. 35 is a rear elevational view taken along line 35-35 of FIG. 34 showing a pronated foot requiring correction. FIG. 36 is a rear elevational view of the pronated foot received within the heel cup of orthotic 3418. As seen the orthotic heel cup pivots to provide the therapeutic correction to the pronated foot.

Figure 37:
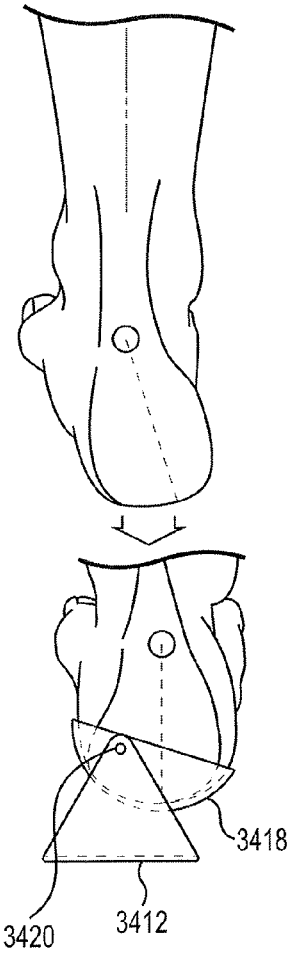
FIG. 37 depicts a supinated foot descending into the bi-layer orthotic in accordance with the invention of FIG. 34 and showing the correction.

Similarly, FIG. 37 is a dynamic rear elevational view similar to that of FIG. 36 showing a supinated foot that required correction and showing the correction as the foot is received by the orthotic heel cup and the heel cup pivots to correct the supinated foot during the gait cycle.

Figure 38A:
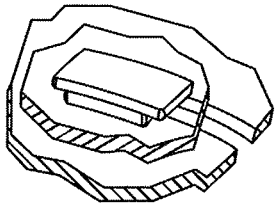
FIG. 38A is an enlarged fragmentary pictorial detail taken from the area 38A of FIG. 38 the bi-layer orthotic of FIG. 38.
Figure 38:
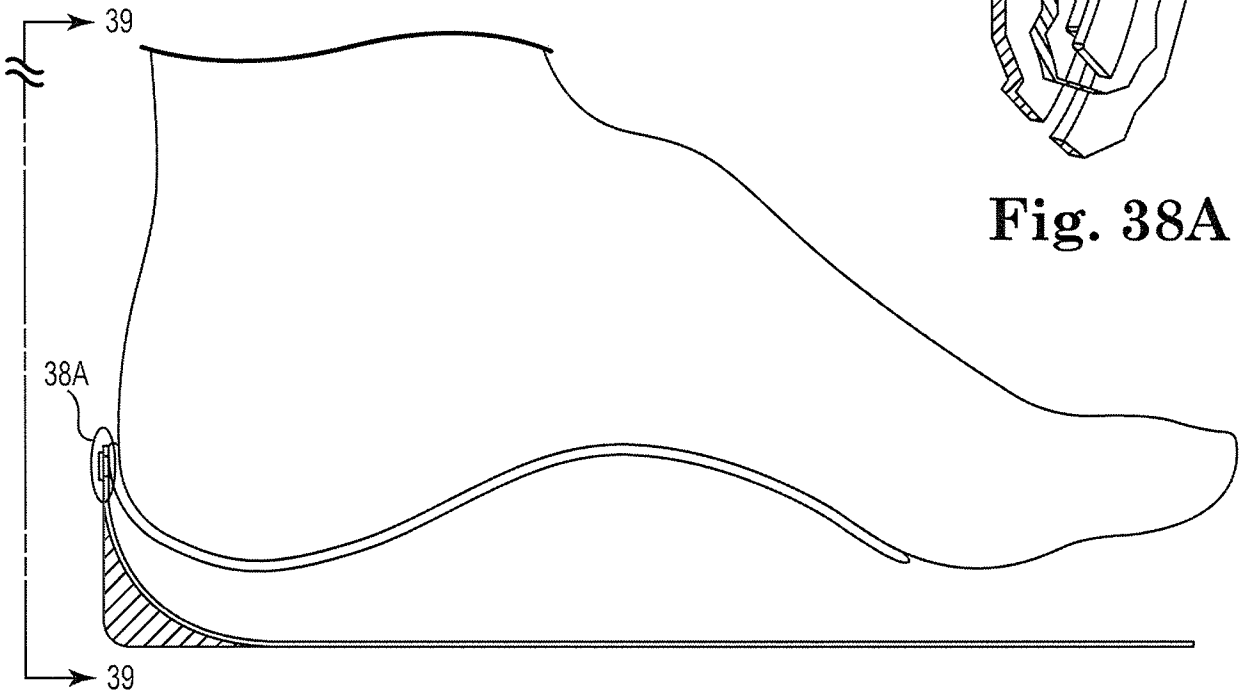
FIG. 38 is a side elevational view of a first alternative bi-layer orthotic embodiment in accordance with the invention with parts omitted for clarity.
Figure 39:
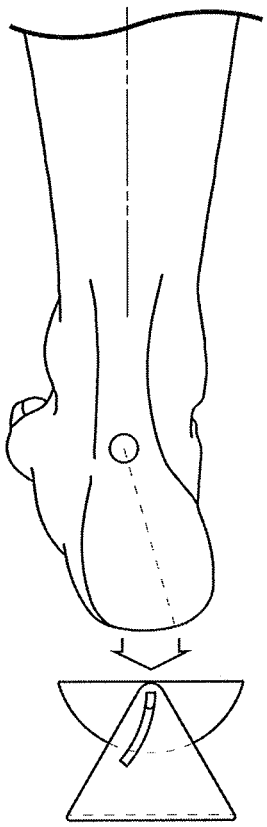
FIG. 39 is a rear elevational view of the orthotic of FIG. 38 taken along line 39-39 and showing a supinated foot requiring correction descending into the orthotic.
Figure 40:
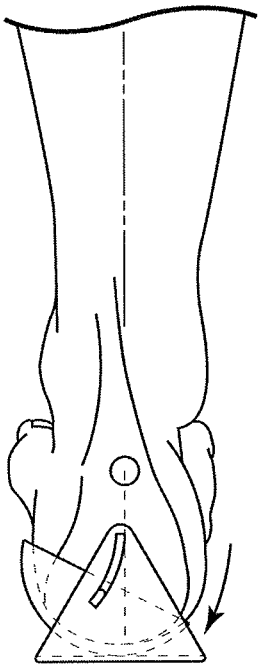
FIG. 40 is a rear elevational view thereof showing the therapeutic correction using the bi-layer orthotic of FIG. 39 in accordance with the invention.
Figure 41:
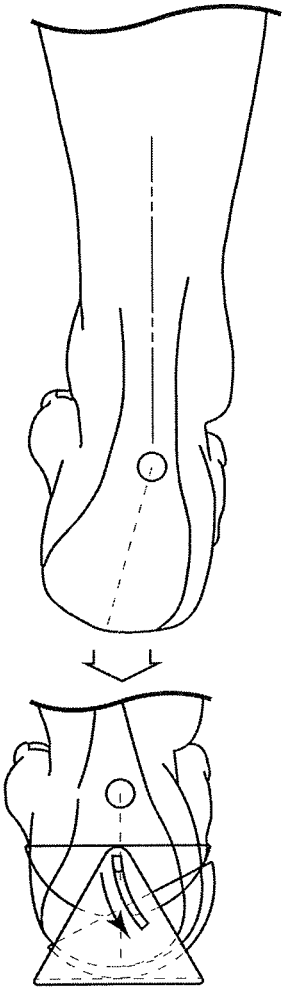
FIG. 41 is a rear elevational view similar to that of FIGS. 39 and 40 showing the correction of a pronated foot using the bi-layer orthotic of FIG. 38 in accordance with the invention.

FIG. 38 is a side elevational view of a first alternative bi-layer orthotic embodiment in accordance with the invention again with a cushioning layer between the orthotic 318 and base layer 3812 omitted for clarity. Bi-layer orthotic 3800 includes base layer 3812 and orthotic 3818. Orthotic 3818 is coupled to base layer 3812 by arcuate rotator follower 3420 as best seen in the enlarged view depicted in FIG. 38A. As best seen in FIGS. 39-41 arcuate rotator follower 3420 travels in channel 3924, 3925. Channel 3924, 3925 is curved in the bi-layer orthotic to the right or left depending on the required correction, i.e. pronation or supination.

FIG. 39 is a rear elevational view taken along line 39-39 in FIG. 38 with the addition of the lower portion of a leg and supinated foot requiring correction. FIG. 40 is a rear elevational view thereof showing the therapeutic correction using the bi-layer orthotic in accordance with the invention. FIG. 41 is a dynamic rear elevational view similar to that of FIG. 36 with a pronated foot that required correction showing the correction. As can be seen in each of these FIGS. arcuate rotator follower 3420 travels in channel 3924, 3925 to the right or left depending on the required correction.

Figure 42:
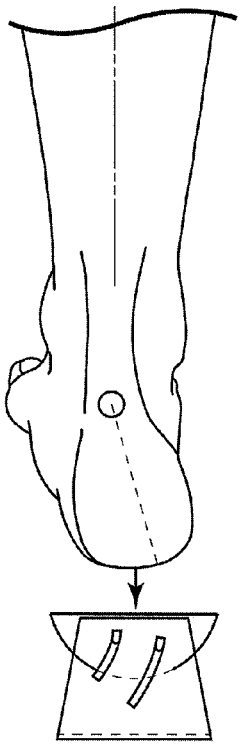
FIG. 42 is a rear elevational view of a second alternative embodiment of a bi-layer orthotic similar to that of FIG. 38 but including two arcuate channels and showing a pronated foot descending downward into the orthotic.
Figure 43:
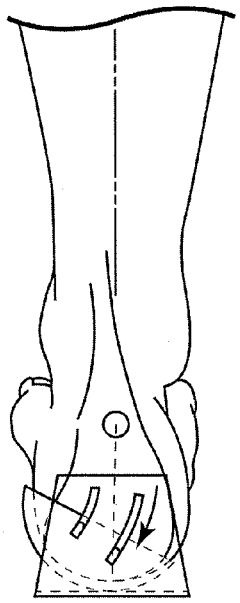
FIG. 43 is a view similar to that of FIG. 42 showing the correction of the pronated foot.
Figure 44:
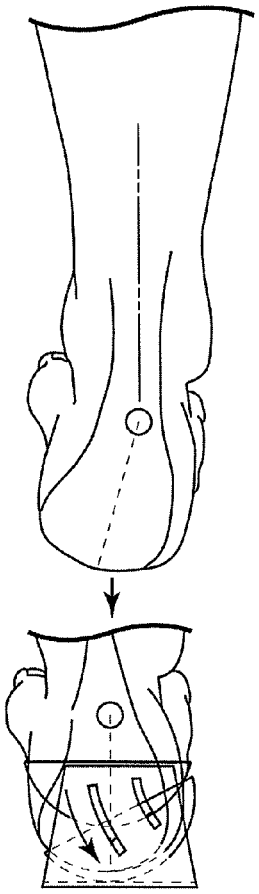
FIG. 44 is similar to the embodiment of FIGS. 42 and 43 wherein a supinated foot is shown descending and then having been corrected by the bi-layer orthotic of FIG. 42 in accordance with the invention.

FIG. 42 is a rear elevational view of a second alternative embodiment of a bi-layer orthotic similar to that shown in FIG. 38 but including two arcuate channels and showing a pronated foot descending downward into the orthotic. FIG. 43 is a view similar to that of FIG. 42 showing the correction of the pronated foot. FIG. 44 is similar to the embodiment of FIGS. 42 and 43 wherein a supinated foot is shown descending and then having been corrected by the bi-layer orthotic of FIG. 42 in accordance with the invention.

Figure 46:
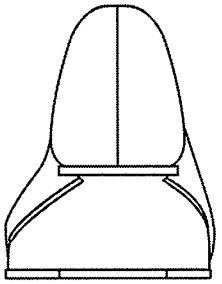
FIG. 46 is a rear elevational view thereof.
Figure 45:
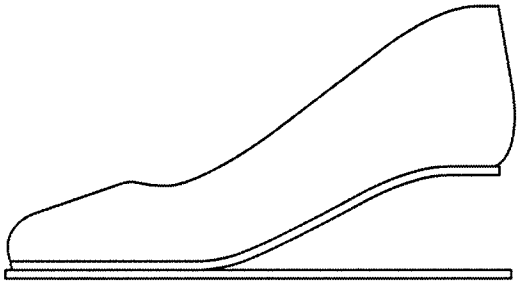
FIG. 45 is a side elevational view of a third alternative embodiment of a bi-layer orthotic in accordance with the invention with parts omitted for clarity.
Figure 48:
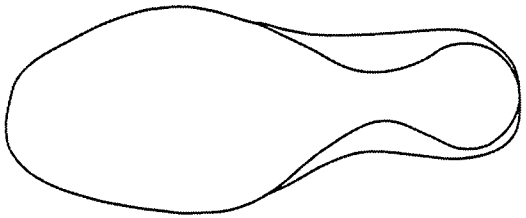
FIG. 48 is a bottom plan view thereof.
Figure 47:
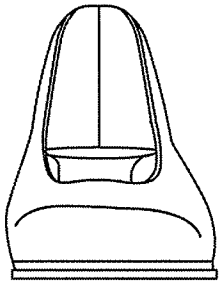
FIG. 47 is a front elevational view thereof.
Figure 49:
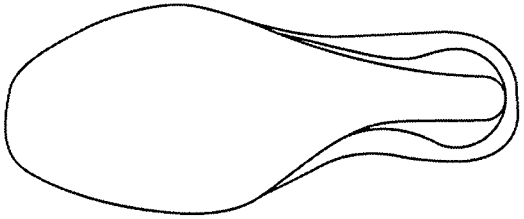
FIG. 49 is a bottom plan view of a first alternative embodiment of the bi-layer orthotic of FIGS. 45-48 in accordance with the invention.
Figure 50:
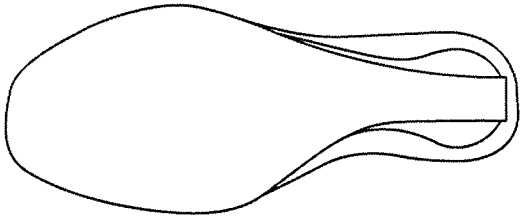
FIG. 50 is a bottom plan view of a second alternative embodiment of the bi-layer orthotic of FIGS. 45-48 in accordance with the invention.
Figure 51:
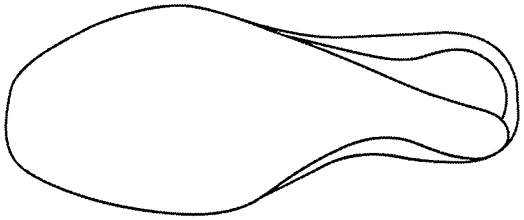
FIG. 51 is a bottom plan view of a third alternative embodiment of the bi-layer orthotic of FIGS. 45-48 in accordance with the invention.
Figure 52:
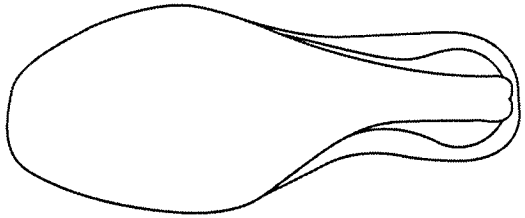
FIG. 52 is a bottom plan view of a fourth alternate embodiment of the bi-layer orthotic of FIGS. 45-48 in accordance with the invention.

FIG. 45 is a side elevational view of a third alternative embodiment of a bi-layer orthotic in accordance with the invention with cushioning layer omitted for clarity and especially designed for women's footwear. FIG. 46 is a rear elevational view thereof. FIG. 47 is a front elevational view thereof. FIG. 48 is a bottom plan view thereof FIG. 49 is a bottom plan view of a first alternative embodiment of the bi-layer orthotic of FIGS. 45-48 in accordance with the invention. FIG. 50 is a bottom plan view of a second alternative embodiment of the bi-layer orthotic of FIGS. 45-48 in accordance with the invention. FIG. 51 is a bottom plan view of a third alternative embodiment of the bi-layer orthotic of FIGS. 45-48. FIG. 52 is a bottom plan view of a fourth alternative embodiment thereof.

Figure 53:
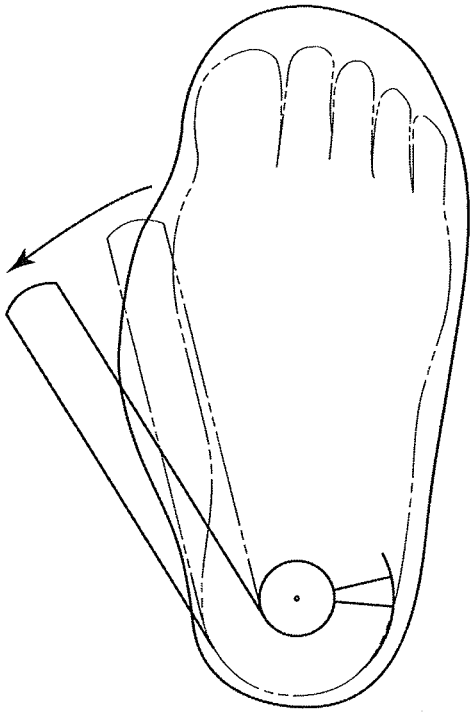
FIG. 53 is a top plan view of an alternative embodiment of an orthotic in accordance with the invention showing a kick stand strut.
Figure 54:
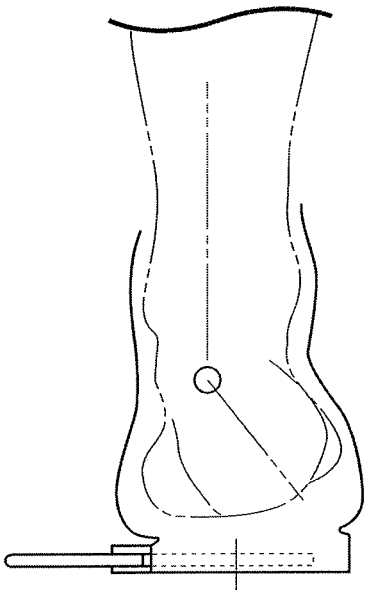
FIG. 54 is a rear view of a supinated foot showing the kick stand strut deployed.

FIG. 53 is a top plan view of an alternative embodiment of an orthotic in accordance with the invention showing kick stand 5300. The kick stand 5300 is pivotally coupled to orthotic 5316 at heel 5317. Medial movement of the kick stand allows pronation of foot to be corrected. When kick stand 5300 is deployed the foot moves laterally, as best seen, in FIG. 54 due to the decrease in forefoot abduction. Compressibility of the bilayer orthotic allows patient tolerability of dynamic control due to shock absorption. Those of skill in the art will appreciate that the kick stand 5300 could be placed on the lateral side of the orthotic to correct pronation.

Figure 55:
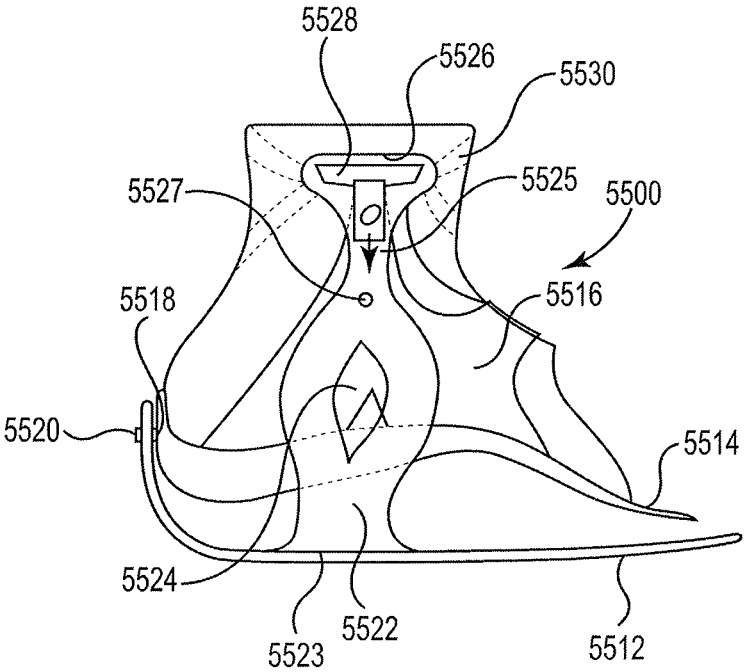
FIG. 55 is an alternative embodiment of a bi-layer orthotic in accordance with the invention.
Figure 56:
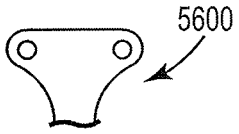
FIG. 56 is a fragmentary side elevational detail view of the part of the embodiment of FIG. 55.

Turning now to FIGS. 55-56 an alternative embodiment of the bi-layer orthotic in accordance with the invention is shown. Bi-layer orthotic 5500 broadly includes dynamic base layer 5512, orthotic 5514 and boot 5516. As can be seen base layer 5512 is operably coupled to orthotic 5514 at the heel 5518 of the orthotic by off axis rotator axel 5420. Off axis rotator axel 5520 is pivotally received by base layer 5512 and orthotic 5514 so that orthotic 5514 pivots relative to the base 5512. Dynamic base layer 5512 includes upright supports 5522 operably connected at a first end 5523 thereto. Upright supports 5522 include cutouts 5524 for malleoli (ankle bones). Upright supports 5522 include optional hinge pin 5527 that operably couples upright support 5522 to boot 5516. Hinge pin 5527 allows for articulation if ankle range of motion is desired. Upright supports 5522 terminate at a second end 5525 with pull tab 5526.

Pull tab 5526 is fixedly coupled to boot 5516 and includes finger portion 5528 that allow a user to pull on it to facilitate easy donning of the boot 5516. Boot 5516 may optionally include straps 5530. Straps 5530 act to limit anterior/posterior displacement of the foot relative to the upright supports 5522 and are positioned such that they do not encircle the ankle or lower leg thus avoiding constriction and/or irritation of that anatomy. FIG. 56 depicts a second pull tab 5600 that may be positioned within an upper edge of boot 5516 to facilitate donning of the boot. Second pull tab 5600 may include a neoprene like padded collar to accommodate edema and changes in leg size.

Those of skill in the art will appreciate that the disclosed embodiments in accordance with the invention are designed to accommodate numerous modifications as hereinbefore described. Thus, although the present invention has been described with reference to certain embodiments, those of ordinary skill in the art will recognize that changes may be made in form and detail without departing from the spirit and scope of the invention.

What is claimed is:

1. An energy return system comprising:

a base;

an orthotic;

a platen operably coupled directly or indirectly to said base, said orthotic or both;

a lever including a slide portion in moveable contact with said base;

and a tensioning member having a first end coupled to said lever and a second end coupled to said orthotic.

2. The energy return system of claim 1 wherein said lever further comprises an angled connecting portion in operable attachment to said slide portion and a connection member.

3. The energy return system of claim 1 wherein said platen includes an aperture therethrough for receiving said tensioning member.

4. The energy return system of claim 1 wherein said orthotic is constructed of a resilient material that allows dynamic deformation of said orthotic during the gait cycle.

5. The energy return system of claim 4 wherein said resilient material is selected from polyolefin, polypropylene, open and closed cell foams, graphites and combinations of the foregoing.

6. The energy return system of claim 1 wherein said tensioning member is selected from a pin, a rod, a cable, a wire, a filament and combinations of the foregoing.

7. The energy return system of claim 1 further comprising a heel cup for coupling said platen to said orthotic.

8. The energy return system of claim 7 further comprising a pin for coupling said platen to said orthotic.

9. The energy return system of claim 7 wherein said heel cup is coupled to said orthotic and said platen by adhesive or chemical bonding.

10. The energy return system of claim 1 wherein said platen is coupled to said orthotic at a front portion thereof.

11. The energy return system of claim 1 wherein said base is structured to absorb energy and provide shock absorption at heel strike and release energy.

12. The energy return system of claim 1 wherein said platen comprises a rigid or semi-rigid material.

13. The energy return system of claim 1 wherein said lever further includes a fulcrum in operable contact with said platen and a terminal portion.

14. The energy return system of claim 13 further comprising a cable having first and second ends, said first end operably coupled to said orthotic and said second end operable coupled to said terminal portion.

15. The energy return system of claim 1 further comprising wherein said platen is operably coupled to said base layer at a front end thereof.

16. The energy return system of claim 15 further comprising a gusset structured to operably coupled said platen to said base layer.

17. The energy return system of claim 1 wherein said tensioning member is coupled to said orthotic forward of a sulcus.

18. The energy return system of claim 1 wherein said base layer and said platen are coupled underneath a ball of the foot.

19. The energy return system of claim 1 wherein the second end of said tensioning member is operably coupled to said orthotic underneath a sole of a foot.

20. The energy return system of claim 1 wherein said platen is fixedly coupled at a distal end thereof to orthotic and wherein a proximal end of said orthotic is non-coupled.

21. The energy return system of claim 1 wherein said base layer is fixedly attached at a proximal end there to platen.

22. The energy return system of claim 1 wherein said base layer is fixedly attached to platen by a bridge.

23. The energy return system of claim 22 wherein said tensioning member is operably coupled to the orthotic underneath an arch of a foot.

24. The energy return system of claim 1 wherein said orthotic includes one or more segments on a lateral side thereof and said tensioning member is coupled medial to a subtalar joint access and operably coupled to said orthotic distally under a first ray.

25. The energy return system of claim 1 wherein said orthotic includes one or more segments on a lateral side thereof and said tensioning member is coupled lateral to a subtalar joint access toward a fifth ray of a foot.

26. The energy return system of claim 1 wherein said orthotic includes one or more segments and said tensioning member is coupled to any of the segments.

27. An energy return system comprising:

a base layer;

an orthotic;

a platen operably coupled directly or indirectly to said base, said orthotic or both;

a lever including a slide portion in movable contact with said base;

a band structured to surround phlanges of a patient and a tensioning member having a first end coupled to said lever and a second end coupled to said band.

28. The energy return system of claim 27 wherein said tensioning member comprises a cable.

29. The energy return system of claim 27 wherein said platen is operably coupled to said base layer at a point underneath a ball of the foot.

* * * * *